US009529293B2

(12) United States Patent
Fujisaki et al.

(10) Patent No.: US 9,529,293 B2
(45) Date of Patent: Dec. 27, 2016

(54) TONER FOR ELECTROSTATIC CHARGE IMAGE DEVELOPMENT

(71) Applicant: Konica Minolta, Inc., Tokyo (JP)

(72) Inventors: Natsuko Fujisaki, Hino (JP); Tomomi Oshiba, Hachioji (JP); Makoto Nomiya, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/048,233

(22) Filed: Feb. 19, 2016

(65) Prior Publication Data

US 2016/0246198 A1 Aug. 25, 2016

(30) Foreign Application Priority Data

Feb. 25, 2015 (JP) ..... 2015-035698

(51) Int. Cl.
*G03G 9/087* (2006.01)
*G03G 9/08* (2006.01)

(52) U.S. Cl.
CPC ..... *G03G 9/08755* (2013.01); *G03G 9/0804* (2013.01); *G03G 9/0825* (2013.01); *G03G 9/08782* (2013.01); *G03G 9/08786* (2013.01); *G03G 9/08795* (2013.01); *G03G 9/08797* (2013.01)

(58) Field of Classification Search
CPC ..... G03G 9/08755
See application file for complete search history.

(56) References Cited

U.S. PATENT DOCUMENTS

2006/0057483 A1* 3/2006 Yanase ..... G03G 9/0825 430/108.4
2006/0292476 A1 12/2006 Maehata et al.
(Continued)

FOREIGN PATENT DOCUMENTS

EP 1930781 A2 6/2008
EP 2813895 A1 12/2014
(Continued)

OTHER PUBLICATIONS

Extended European Search Report dated Jun. 29, 2016 from the corresponding European Application; Application No./Patent No. 16156842.3-1303; Applicant: Konica Minolta, Inc.; Total of 7 pages.

(Continued)

*Primary Examiner* — Hoa V Le
(74) *Attorney, Agent, or Firm* — Lucas & Mercanti, LLP

(57) ABSTRACT

Provided is a toner for electrostatic charge image development which satisfies both low temperature fixability and an excellent storage stability and realizes excellent chargeability, fixing separation property, and flowability. According to the present invention, there is provided a toner for electrostatic charge image development comprising toner particles which comprises a binder resin including a crystalline polyester resin and a release agent, in which the crystalline polyester resin has a lamellar structure and the lamellar structure is present only on the inside of the toner particle when a cross-section of the toner particle subjected to ruthenium staining is observed with a transmission electron microscope.

15 Claims, 1 Drawing Sheet

(56) References Cited

U.S. PATENT DOCUMENTS

| | | | | |
|---|---|---|---|---|
| 2013/0011779 | A1* | 1/2013 | Yamashita | G03G 9/0806 430/109.4 |
| 2013/0273467 | A1 | 10/2013 | Ashizawa et al. | |
| 2014/0363763 | A1 | 12/2014 | Shibata et al. | |

FOREIGN PATENT DOCUMENTS

| | | | |
|---|---|---|---|
| JP | 2002287426 | A | 10/2002 |
| JP | 2005338548 | A | 12/2005 |
| JP | 2006106727 | A | 4/2006 |
| JP | 2011069976 | A | 4/2011 |
| JP | 2013235248 | A | 11/2013 |
| JP | 2013257404 | A | 12/2013 |
| JP | 2014063000 | A | 4/2014 |
| JP | 2014186188 | A | 10/2014 |

OTHER PUBLICATIONS

Notification of Reasons for Refusal dated Jul. 26, 2016 from corresponding Japanese application; Patent Application No. 2015-035698; English translation of Notification of Reasons for Refusal; Total of 7 pages.

Notification of Reasons for Refusal dated Oct. 25, 2016 from corresponding Japanese Application; Patent Application No. 2015-035698; Translation of Notification of Reasons for Refusal; Total of 8 pages.

* cited by examiner

TONER FOR ELECTROSTATIC CHARGE IMAGE DEVELOPMENT

CROSS-REFERENCE TO RELATED APPLICATION

This application is based on Japanese Patent Application No. 2015-035698 filed on Feb. 25, 2015, the contents of which are incorporated herein by reference.

BACKGROUND

Technical Field

The present invention relates to a toner for electrostatic charge image development, and more specifically to a toner for electrostatic charge image development which achieves both low temperature fixability and a heat-resistant storage property and has excellent chargeability, fixing separation property, and flowability.

Description of Related Arts

Recently, with the progress of colorization and an increase in speed of copying machines, an environmentally friendly toner with low cost and high image quality has been demanded in electrophotographic fields. In order to meet this demand, conversion is progressing from a conventional crushed type toner to a chemical toner. As a method for producing a chemical toner, various methods have been examined, and products produced by some of these methods are on the market. However, there is a demand to further lower costs of copying machines or printers on which a toner is mounted, and demands for toner characteristics for achieving high image quality are further increasing.

Further, recently, in printers and copying machines, as the transition from analogue system to digital system further progresses, there are strong demands for improvement in a printing speed and a decrease in power consumption to be used as well as high resolution. As measures therefor, a decrease in fixing temperature of a toner is increasingly demanded. In the related art, a decrease in fixing temperature of a toner has been studied in many cases, and as a representative study thereof, one using a crystalline material is exemplified.

For example, a technique disclosed in JP 2002-287426 A (corresponds to US 2003/039910 A1) has been proposed in which a high-quality image having excellent low temperature fixability and a favorable storage property can be obtained by adjusting a dispersed domain diameter of a crystalline polyester resin in a toner containing a crystalline polyester resin and an amorphous resin. In addition, a technique disclosed in JP 2006-106727 A has been proposed in which both of excellent low temperature fixability and storage stability can be achieved by defining a lamellar structure of a crystalline polyester resin and disposing the lamellar structure on the surface of a toner and thus a high image density without fogging can be obtained.

However, there is still room for improvement in these toners of the related art in that both the low temperature fixability and the storage stability are achieved and important qualities, as toner performance and image quality, such as fixing separation property, chargeability, and toner flowability are also satisfied.

SUMMARY

In this regard, an object of the present invention is to provide a toner for electrostatic charge image development which satisfies both the low temperature fixability and the excellent storage stability and realizes excellent chargeability, fixing separation property, and flowability.

The present inventors conducted earnest studies to solve the above problems, and as a result, they found that the above problems can be solved by using a specific crystalline polyester resin for a binder resin, thereby completing the present invention.

To achieve at least one of the above-mentioned objects, a toner for electrostatic charge image development comprising toner particles which comprises a binder resin containing a crystalline polyester resin and a release agent, in which the crystalline polyester resin has a lamellar structure and the lamellar structure is present only on the inside of the toner when a cross-section of the toner subjected to ruthenium staining is observed with a transmission electron microscope.

DETAILED DESCRIPTION

The present invention relates to a toner for electrostatic charge image development including toner particles containing at least a release agent and a binder resin containing a crystalline polyester resin. Further, the present invention is characterized in that the crystalline polyester resin has a lamellar structure and the lamellar structure is present only on the inside of the toner particle when a cross-section of the toner particle subjected to ruthenium staining is observed with a transmission electron microscope. The toner for electrostatic charge image development of the present invention having such a constitution can satisfy both the low-temperature fixability and the excellent heat-resistance storage property and realize excellent chargeability, fixing separation property, and flowability.

Figure 1:
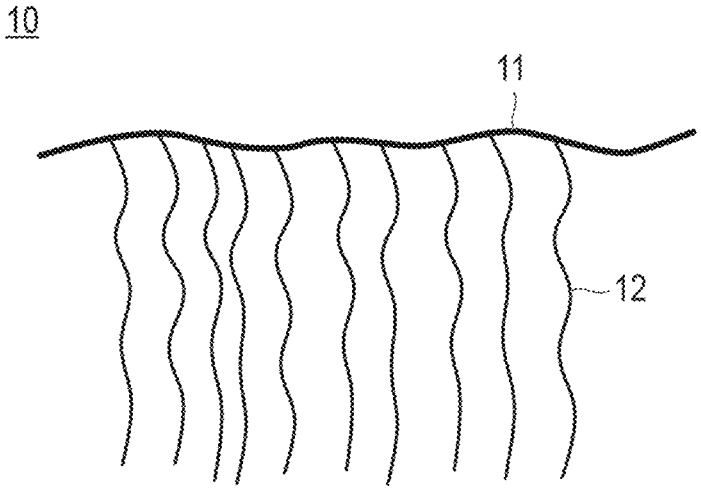
FIG. 1 is a schematic diagram for describing a lamellar structure included in a toner particle of the present invention, and 10 represents a hybrid crystalline polyester resin, 11 represents a styrene-acrylic resin unit and 12 represents a crystalline polyester resin unit, respectively.

The lamellar structure means a layered structure generated by crystallization caused by the folding of the molecular chain of a crystalline polymer. FIG. 1 illustrates an example of a crystalline polyester resin which can form a lamellar structure and a schematic diagram illustrating a hybrid crystalline polyester resin 10. The hybrid crystalline polyester resin 10 has the structure in which a crystalline polyester resin unit 12 is chemically bonded, as a side chain, to a styrene-acrylic resin unit 11 as amain chain. As illustrated in FIG. 1, the crystalline polyester resin unit 12 is bonded to the styrene-acrylic resin unit 11 in the form of a comb. Such a comb-shaped structure is formed by folding the crystalline polyester resin unit 12 in, for example, a resin different from the polyester resin so as to crystallize and forms the lamellar structure. Incidentally, in the specification, the term "unit" is synonymous with the term "segment".

Figure 2:
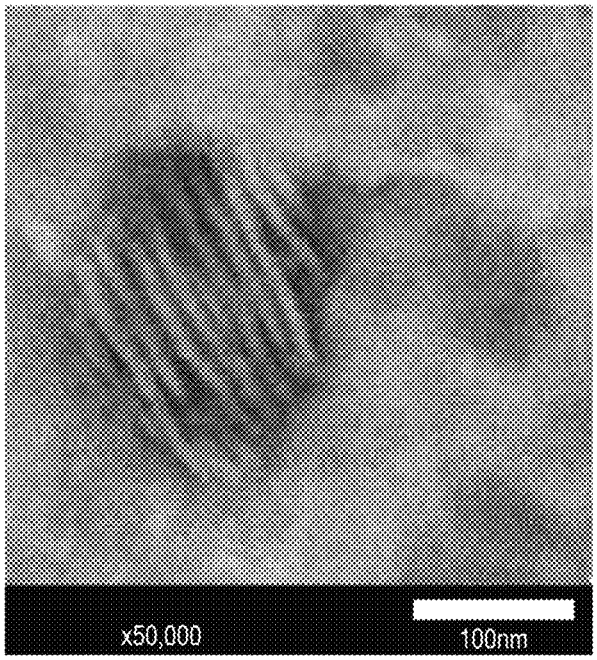
FIG. 2 is an observation image of the lamellar structure included in the toner particle of the present invention.

FIG. 2 is an observation image obtained by staining a hybrid crystalline polyester resin having a lamellar structure with ruthenium according to a method to be described later and then observing the ruthenium-stained resin with a transmission electron microscope (TEM). As shown in FIG. 2, the crystalline polyester resin unit bonded in the form of a comb forms a layered lamellar structure.

In order to confirm existence of the lamellar structure, a toner particle is stained by ruthenium staining and then the cross-section of the toner particle is observed with a transmission electron microscope (TEM). More specifically, a method and conditions which will be described in Examples to be described later are employed.

Further, in the toner of the present invention, the lamellar structure of the crystalline polyester resin is present only on the inside of the toner particle. Here, the inside of the toner particle means a region extending from the surface of the toner particle to a depth 0.1 times or more the particle diameter of the toner particle. In the toner of the present invention, the lamellar structure of the crystalline polyester resin is not present on the region extending from the surface of the toner particle to a depth less than 0.1 times the particle diameter of the toner particle.

In the present invention, when the cross-sections of 100 toner particles are observed by the above method, in the cross-sections, toner particles including the lamellar structure of the crystalline polyester resin only on the inside of the toner particle exist in 80% or more of the total toner particles, and such a toner is defined in the present specification as the "toner in which the lamellar structure is present only on the inside of the toner particle."

When the content of the toner particles including the lamellar structure only on the inside of the toner particle are 80% or more of the total toner particles, improvement in the low temperature fixability, the heat-resistant storage property, the chargeability, the fixing separation property, and the flowability, which are desired effects of the invention, are achieved. The content of the toner particles including the lamellar structure of the crystalline polyester resin only on the inside of the toner particle is preferably 90% or more of the total toner particles.

Further, in the present specification, the expression "the lamellar structure of the crystalline polyester resin is not present on the region extending from the surface of the toner particle to a depth less than 0.1 times the particle diameter of the toner particle" means that, when the cross-sections of 100 toner particles are observed, in the cross-sections, the content of the toner particles in which the lamellar structure of the crystalline polyester resin is not present on the region extending from the surface of the toner particle to a depth less than 0.1 times the particle diameter of the toner particle exist in 80% or more of the total toner particles. The content of the toner particles in which the lamellar structure of the crystalline polyester resin is not present on the region extending from the surface of the toner particle to a depth less than 0.1 times the particle diameter of the toner particle is preferably 90% or more of the total toner particles.

Since the crystalline polyester resin contributes greatly to the low temperature fixability, the low temperature fixability is realized by using the crystalline polyester resin. However, with the investigation of the present inventors, it is found that the low temperature fixability cannot be sufficiently exerted depending on the presence state of the crystalline polyester resin in the toner particle. However, in the toner of the present invention, if the lamellar structure of the crystalline polyester resin is present only on the inside of the toner particle as described above, the fusion of the binder resin is more effectively promoted using the lamellar structure as a starting point and the low temperature fixability can be exerted. On the other hand, in the case of a threadlike polyester resin of which structure is not regular but irregular and which does not form a lamellar structure, the polyester resin has a weak ability as a fusion starting point, that is, an initiating agent.

Regarding the heat-resistant storage property, when the lamellar structure of the crystalline polyester resin is present only on the inside of the toner particle, the heat-resistant storage property is improved. On the other hand, it was found that, when the lamellar structure of the crystalline polyester resin is present on the region extending from the surface of the toner particle to a depth less than 0.1 times the particle diameter of the toner particle, the heat-resistant storage property may deteriorate in some cases.

Regarding the chargeability, since the polyester resin has a high ratio of oxygen contained in the resin, there is a tendency that the hydrophilicity of the resin increases and the chargeability of the toner decreases. According to this, there is a tendency that it is difficult to stably obtain an image with a high image density at a broad fixing temperature. On the other hand, it was found that, in a case where the lamellar structure of the crystalline polyester resin is present only on the inside of the toner particle, a decrease in chargeability is prevented. Therefore, in order to maintain the chargeability while the polyester resin is used, it is important that the lamellar structure of the crystalline polyester resin is present on the inside of the toner particle.

Regarding the fixing separation property, it was found that bleeding of the release agent greatly influences the separation property of a belt, and as the bleeding amount increases, the separation property thereof is improved. In order to improve the fixing separation property, it is important to increase the bleeding amount of the release agent in a short time. On the other hand, in the toner of the present invention, since the lamellar structure of the crystalline polyester resin is present only on the inside of the toner particle, the release agent can be efficiently bled out from the inside of the toner particle at once at the time of deformation in fixing of the toner. Therefore, the fixing separation property can be improved.

Furthermore, since the lamellar structure of the crystalline polyester resin is present only on the inside of the toner particle, the flowability of the toner is also favorably maintained. On the other hand, when the lamellar structure of the crystalline polyester resin is present on the region extending from the surface of the toner particle to a depth less than 0.1 times the particle diameter of the toner particle, there is a concern that the flowability of the toner deteriorates. When the lamellar structure is present on the region extending from the surface of the toner particle to a depth less than 0.1 times the particle diameter of the toner particle, it is considered that the flowability of the toner is impaired due to the localization of electrostatic distribution caused by charge inhomogeneity in this region or the irregularity of the surface shape. In order not to deteriorate the flowability of the toner, it is important that the lamellar structure of the crystalline polyester resin is preferably disposed on the inside of the toner particle.

In order to cause the lamellar structure of the crystalline polyester resin to be present only on the inside of the toner particle, the following methods are mentioned. For example, there are (1) a method of putting a dispersion liquid of the crystalline polyester resin in a mixed dispersion liquid before raising the temperature in a method for producing the toner to be described later, (2) a method of using a hybrid crystalline polyester resin as the crystalline polyester resin, (3) a method of using a long-chain acrylic acid ester as a monomer species of a binder resin other than a crystalline polyester resin, and a combination of any of (1) to (3) methods.

In the toner of the present invention, the domain diameter of the lamellar structure is preferably 0.1 to 2 μm. The domain means a structure which exists, as an island phase having a closed interface (boundary between a phase and a phase), in a matrix that is a continuous phase. Regarding the domain diameter, the maximum length of the domain in the cross-section of the toner particle, that is, a horizontal maximum cord (CORD H) is defined as a domain diameter. The method for measuring the domain diameter follows a method described in Examples to be described later. Regarding the measurement number of the domain diameters of the lamellar structure, the measurement is performed on 100 toner particles. In the toner of the present invention, the content of the toner particles having a domain diameter of the lamellar structure in the range of 0.1 to 2 μm is preferably 60% or more and more preferably 80% or more of the total toner particles. When the domain diameter of the lamellar structure is in such a range, the low temperature fixability and the fixing separation property of the toner may be further improved. The domain diameter of the lamellar structure is more preferably 0.6 to 2 μm.

Further, in the cross-section of the toner particle subjected to ruthenium staining as described above, the ratio of the cross-sectional area of the lamellar structure to the cross-sectional area of the toner particle is preferably 1 to 20%. When the cross-sectional area ratio of the lamellar structure with respect to the toner particle is in such a range, the low temperature fixability and the fixing separation property of the toner may be further improved. The cross-sectional area of the lamellar structure with respect to the toner particle is calculated by a method described in Examples to be described later. In the cross-section of the toner particle subjected to ruthenium staining as described above, the ratio of the cross-sectional area of the lamellar structure to the cross-sectional area of the toner particle is more preferably 5 to 15%. The cross-sectional area of the lamellar structure indicates the cross-sectional area of the domain portion of the lamellar structure, that is, the portion of the structure which exists, as an island phase having a closed interface (boundary between a phase and a phase), in a matrix that is a continuous phase.

Hereinafter, constituents of the toner for electrostatic charge image development of the present invention will be described.

[Binder Resin]

A binder resin used in the toner of the present invention contains a crystalline polyester resin, and the crystalline polyester resin has the above-described lamellar structure. As the binder resin, another resin that contains a crystalline polyester resin and becomes a matrix can be further contained. As the binder resin other than a crystalline polyester resin, a styrene-acrylic modified polyester resin, a vinyl resin, an amorphous polyester resin, and the like are exemplified.

(Crystalline Polyester Resin)

The crystalline polyester resin is a well-known polyester resin formed by polycondensation reaction of a divalent or higher carboxylic acid (polycarboxylic acid) and a dihydric or higher alcohol (polyhydric alcohol), and is a resin which does not have a stepwise endothermic change but has a clear endothermic peak in the differential scanning calorimetry (DSC) of the toner. The clear endothermic peak specifically means a peak in which the half width of the endothermic peak is within 15° C. when measured at a temperature raising rate of 10° C./min in the differential scanning calorimetry (DSC) described in Examples. In the present invention, the crystalline polyester resin may be an unmodified polyester resin, a modified polyester resin, or a hybrid polyester resin as long as it is a resin exhibiting the above-described thermal characteristics. Such a polyester resin is likely to have a structure with high crystallinity.

On the other hand, when the crystalline polyester resin forms a block structure with the amorphous resin, the polyester resin is less likely to have a structure with high crystallinity.

Further, the binder resin is preferably configured by containing a crystalline polyester resin in a resin other than a crystalline polyester resin that becomes a matrix. When the crystalline polyester resin is contained in a resin other than a crystalline polyester resin that becomes a matrix, the added amount of the crystalline polyester resin is preferably 1% by mass or more and less than 50% by mass of the total binder resin, and more preferably 5 to 20% by mass.

The melting point of the crystalline polyester resin is preferably 55° C. or higher and 90° C. or lower, and more preferably 70° C. or higher and 85° C. or lower. When the melting point of the crystalline polyester resin is set to the above ranges, sufficient low temperature fixability is obtained. Incidentally, the melting point of the crystalline polyester resin can be controlled by a resin composition.

The valences of the polycarboxylic acid component and the polyhydric alcohol component each are preferably 2 to 3, and particularly preferably 2. In this regard, a case where the valences thereof each are 2 (that is, a dicarboxylic component and a diol component) will be described as a particularly preferred configuration.

As the dicarboxylic component, aliphatic dicarboxylic acid is preferably used, and aromatic dicarboxylic acid may concurrently be used. As the aliphatic dicarboxylic acid, linear aliphatic dicarboxylic acid is preferably used. When the linear aliphatic dicarboxylic acid is used, there is an advantage in crystallinity is improved. The dicarboxylic component is not limited to one kind thereof, and may be used in a mixture of two or more kinds thereof.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid (dodecanedioic acid), 1,13-tridecanedicarboxylic acid, 1,14-tetradecanedicarboxylic acid, 1,16-hexadecanedicarboxylic acid, and 1,18-octadecanedicarboxylic acid.

Among the aliphatic dicarboxylic acids, from the viewpoint of easily obtaining the effect of the present invention as described above, aliphatic dicarboxylic acid with 6 to 12 carbon atoms is preferable.

Examples of aromatic dicarboxylic acid which can be used together with the aliphatic dicarboxylic acid include phthalic acid, terephthalic acid, isophthalic acid, orthophthalic acid, t-butylisophthalic acid, 2,6-naphthalenedicarboxylic acid, and 4,4'-biphenyldicarboxylic acid. Among these, from the viewpoint of easy availability and easy emulsification, terephthalic acid, isophthalic acid, and t-butylisophthalic acid are preferably used.

In addition, tricarboxylic or higher polycarboxylic acid such as trimellitic acid or pyromellitic acid, an anhydride of the above-described carboxylic compound, or alkyl ester with 1 to 3 carbon atoms may be used.

As the dicarboxylic component for forming the crystalline polyester resin, the content of the aliphatic dicarboxylic acid is set to preferably 50% by construction mole or more, more preferably 70% by construction mole or more, further preferably 80% by construction mole or more, and particularly preferably 100% by construction mole. When the content of the aliphatic dicarboxylic acid in the dicarboxylic component is set to 50% by construction mole or more, the crystallinity of the crystalline polyester resin can be sufficiently secured.

Further, as the diol component, an aliphatic diol is preferably used, and as necessary, a diol other than the aliphatic diol may be contained. As the aliphatic diol, a linear type is preferably used. When the linear type is used, there is an advantage that crystallinity is improved. The diol component may be used alone or in combination of two or more kinds thereof.

Examples of the aliphatic diol include ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and neopentyl glycol.

As the diol component, among the aliphatic diols, aliphatic diol with 2 to 12 carbon atoms is preferable, and aliphatic diol with 6 to 12 carbon atoms is more preferable.

Examples of the diol, which is used as necessary, other than the aliphatic diol include a diol having a double bond and a diol having a sulfonic acid group, and specific examples of the diol having a double bond include 1,4-butenediol 2-butene-1,4-diol, 3-butene-1,6-diol, and 4-butene-1,8-diol. In addition, trihydric or higher polyhydric alcohols such as glycerol, pentaerythritol, trimethylolpropane, and sorbitol are exemplified.

As the diol component for forming the crystalline polyester resin, the content of the aliphatic diol is set to preferably 50% by construction mole or more, more preferably 70% by construction mole or more, further preferably 80% by construction mole or more, and particularly preferably 100% by construction mole. When the content of the aliphatic diol in the diol component is 50% by construction mole or more, the crystallinity of the crystalline polyester resin can be secured. Therefore, excellent low temperature fixability is obtained in a toner to be produced and glossiness is obtained in an image to be finally formed.

The use ratio of the diol component to the dicarboxylic component expressed by the equivalent ratio [OH]/[COOH] of a hydroxyl group [OH] of the diol component to a carboxyl group [COOH] of the dicarboxylic component is preferably 2/1.0 to 1.0/2.0 and more preferably 1.5/1.0 to 1.0/1.5.

Further, it is preferable that the acid value of the crystalline polyester resin be different from the acid value of a release agent to be described later. When the acid value of the crystalline polyester resin is different from the acid value of the release agent, the crystalline polyester resin is likely to form a lamellar structure only in the inside of the toner particle. In particular, the acid value of the crystalline polyester resin is preferably larger than the acid value of the release agent. The acid value of the crystalline polyester resin is preferably 15 mgKOH/g or more. The upper limit is not particularly limited, but is 30 mgKOH/g or less. The acid value can be measured in conformity to the method described in JIS K2501:2003. As a method for controlling the acid value of the crystalline polyester resin, for example, a method for controlling the use ratios of a polycarboxylic acid component and a polyhydric alcohol component, which are used in production of the crystalline polyester resin, or the like is exemplified.

The method for producing the crystalline polyester resin is not particularly limited, and the crystalline polyester resin can be produced by using a well-known esterification catalyst and polycondensing (esterifying) the polycarboxylic acid and the polyhydric alcohol described above.

Examples of the catalyst which can be used in production of the crystalline polyester resin include a compound of an alkali metal such as sodium or lithium; a compound containing a group 2 element such as magnesium or calcium; a compound of a metal such as aluminum, zinc, manganese, antimony, titanium, tin, zirconium, or germanium; a phosphorous acid compound; a phosphoric acid compound; and an amine compound. Specifically, examples of the tin compound include dibutyltin oxide, tin octylate, tin dioctylate, and any salt thereof. Examples of the titanium compound include a titanium alkoxide such as tetra-n-butyl titanate, tetraisopropyl titanate, tetramethyl titanate, or tetrastearyl titanate; a titanium acrylate such as polyhydroxy titanium stearate; and a titanium chelate such as titanium tetraacetylacetonate, titanium lactate, or titanium triethanolaminate. Examples of the germanium compound include germanium dioxide. Furthermore, examples of the aluminum compound include an oxide such as polyaluminum hydroxide, an aluminum alkoxide, and tributyl aluminate. These may be used alone or in combination of two or more kinds thereof.

The polymerization temperature is not particularly limited, but is preferably 150 to 250° C. In addition, the polymerization time is not particularly limited, but is set to preferably 0.5 to 10 hours. During the polymerization, as necessary, the internal pressure of the reaction system may be reduced.

(Hybrid Crystalline Polyester Resin)

In the toner of the present invention, the crystalline polyester resin is preferably a hybrid crystalline polyester resin formed by chemically bonding a crystalline polyester resin unit and an amorphous resin unit other than a polyester resin (hereinafter, also referred to as a hybrid resin). The hybrid crystalline polyester resin forms the above-described lamellar structure, which is favorable. The hybrid crystalline polyester resin may improve the low temperature fixability, the heat-resistant storage property, the chargeability, the fixing separation property, and the flowability of the toner. The hybrid crystalline polyester resin is a resin formed by chemically bonding a crystalline polyester resin unit and an amorphous resin unit other than a polyester resin. The hybrid crystalline polyester resin is preferably a hybrid crystalline polyester resin formed by bonding the crystalline polyester resin unit as the side chain to the styrene-acrylic resin unit as the main chain. In particular, the hybrid crystalline polyester resin preferably has a comb-shaped structure having a styrene-acrylic resin (as the amorphous resin) as a stem and a crystalline polyester resin unit as a branch. When having such a structure, the hybrid resin has a feature that a structure with high crystallinity is easily achieved, and is likely to form a lamellar structure. In addition, when the hybrid crystalline polyester resin is used, it is possible to control the presence state and the position of the crystalline polyester resin and to prevent localization of the crystalline polyester resin on the surface of the toner particle.

The crystalline polyester resin unit indicates a moiety derived from the crystalline polyester resin. That is, the crystalline polyester resin unit indicates a molecular chain of the same chemical structure as a chemical structure constituting the crystalline polyester resin. Further, the amorphous resin unit other than a polyester resin indicates a moiety derived from an amorphous resin other than a polyester resin. That is, the amorphous resin unit indicates a molecular chain of the same chemical structure as a chemical structure constituting the amorphous resin other than a polyester resin. The input amount of the crystalline polyester (the content ratio of the hybrid crystalline polyester resin to the total binder resin) is preferably 1% by mass or more and less than 50% by mass, and more preferably 5% by mass or more and less than 50% by mass, and further preferably 5 to 20% by mass.

The weight average molecular weight (Mw) of the hybrid resin is preferably 5,000 to 100,000, more preferably 7,000 to 50,000, and particularly preferably 8,000 to 20,000. The number average molecular weight (Mn) thereof is preferably 100 to 50,000, andmore preferably 1,000 to 10,000. The weight average molecular weight and the number average molecular weight can be measured by a method to be described below.

The melting point of the hybrid crystalline polyester resin is preferably 55° C. or higher and 90° C. or lower, more preferably 65° C. or higher and 85° C. or lower. When the melting point of the hybrid crystalline polyester resin is within the above ranges, sufficient low temperature fixability is obtained. The melting point of the hybrid crystalline polyester resin can be controlled by a resin composition.

((Crystalline Polyester Resin Unit))

The crystalline polyester resin unit is the same as the crystalline polyester resin and is a moiety derived from a well-known polyester resin formed by polycondensation reaction of the same polycarboxylic acid and polyhydric alcohol. The crystalline polyester resin unit is not particularly limited as long as it is defined as described above. For example, regarding a resin having a structure in which another component is copolymerized in amain chain made of a crystalline polyester resin unit or a resin having a structure in which a crystalline polyester resin unit is copolymerized in a main chain made of another component, if a toner containing the aforementioned resin exhibits an explicit endothermic peak as described above, such a resin corresponds to the hybrid resin having a crystalline polyester resin unit described in the present invention.

A polycarboxylic acid component and a polyhydric alcohol component constituting the crystalline polyester resin unit are the same as those in the crystalline polyester resin described above, and thus the description thereof will not be repeated.

The content of the crystalline polyester resin unit is preferably 80% by mass or more and less than 98% by mass with respect to the total amount of the hybrid crystalline polyester resin. In addition, the content thereof is more preferably 90% by mass or more and less than 95% by mass, and further preferably 91% by mass or more and less than 93% by mass. When the content is set to be within the above ranges, sufficient crystallinity can be imparted to the hybrid resin. Incidentally, the constituent and the content ratio of each unit in the hybrid resin can be specified by, for example, NMR measurement and P-GC/MS measurement using methylation reaction.

Furthermore, in the crystalline polyester resin unit, a compound which could be chemically bonded to the amorphous resin unit, which will be specifically described below, may be polycondensed in addition to the polycarboxylic acid and the polyhydric alcohol described above. As specifically described below, the amorphous resin unit is preferably a vinyl resin unit, and a compound to be subjected to addition polymerization with such a resin unit is preferably used. Therefore, it is preferable that the crystalline polyester resin unit be formed by further polymerizing a compound which can be polycondensed with the polycarboxylic acid and the polyhydric alcohol described above and has an unsaturated bond (preferably, a double bond). Examples of such a compound include polycarboxylic acid having a double bond such as methylene succinic acid or acrylic acid; and polyhydric alcohol having a double bond.

The content of the structural unit derived from the above-described compound in the crystalline polyester resin unit is preferably 0.5 to 20% by mass with respect to the total amount of the crystalline polyester resin unit. Examples of such a compound include polycarboxylic acid having a double bond such as methylene succinic acid; and polyhydric alcohol having a double bond. The content of the structural unit derived from the above-described compound in the crystalline polyester resin unit is preferably 0.5 to 20% by mass with respect to the total amount of the crystalline polyester resin unit.

Here, the hybrid resin contains an amorphous resin unit other than a polyester resin to be specifically described below, in addition to the above-described crystalline polyester resin unit. From the viewpoint of easily forming a lamellar structure, the hybrid resin is preferably a graft copolymer. When the hybrid resin is a graft copolymer, the orientation of the crystalline polyester resin unit is easily controlled and sufficient crystallinity can be imparted to the hybrid resin. In addition, it is preferable that the crystalline polyester resin unit be grafted to an amorphous resin unit other than a crystalline polyester resin as a main chain. That is, the hybrid crystalline polyester resin is preferably a graft copolymer having an amorphous resin unit other than a polyester resin as a main chain and a crystalline polyester resin unit as a side chain. With the above-described configuration, the orientation of the crystalline polyester resin unit can be further enhanced and the crystallinity of the hybrid resin can be improved.

Incidentally, a substituent or bond such as a sulfonic acid group, a carboxyl group, or a urethane bond may be further introduced into the hybrid resin. The introduced place of the substituent may be in the crystalline polyester resin unit, or may be in an amorphous resin unit other than the polyester resin to be specifically described below.

Incidentally, one obtained by introducing the above-described substituent into a crystalline polyester resin, which is not hybridized, is not included in the hybrid crystalline polyester resin of the present invention.

((Amorphous Resin Unit Other than Polyester Resin))

The amorphous resin unit other than a polyester resin (in the present specification, also simply referred to as the "amorphous resin unit" in some cases) can contribute to affinity of a binder resin other than a crystalline polyester resin and the hybrid resin. It is confirm the fact that the amorphous resin unit is contained in the hybrid resin (further, in the toner particle) by, for example, identifying the chemical structure with NMR measurement and P-GC/MS measurement using methylation reaction.

Further, the amorphous resin unit is a resin unit which does not have a melting point and has a relatively high glass transition temperature (Tg) when a resin having the same chemical structure and molecular weight as those of the unit is subjected to the differential scanning calorimetry (DSC).

The amorphous resin unit is not particularly limited as long as it is as defined above. For example, a resin having a structure in which another component is copolymerized to the main chain of an amorphous resin unit or a resin having a structure in which an amorphous resin unit is copolymerized to the main chain composed of another component corresponds to the hybrid resin having an amorphous resin unit of the present invention when a toner particle containing this resin is one which has the amorphous resin unit as described above.

The content of the resin unit other than a crystalline polyester resin is preferably 5 to 30% by mass in the hybrid resin, and more preferably 5 to 20% by mass.

The amorphous resin unit is preferably configured by the same kind of resin as a resin other than the crystalline polyester resin contained in the binder resin. With such a configuration, affinity of the hybrid resin and the binder resin that becomes a matrix is further improved.

Here, the term "same kind of resin" means that a characteristic chemical bond is commonly contained in the repeating units. Here, the term "characteristic chemical bond" follows the "polymer classification" described in the Materials database of the National Institute for Materials Science (NIMS) (http://polymer.nims.go.jp/PoLyInfo/guide/jp/term_polymer.html). That is, the chemical bonds that form polymers which are classified into 22 kinds of polyacryl, polyamide, polyacid anhydride, polycarbonate, polydiene, polyester, polyhaloolefin, polyimide, polyimine, polyketone, polyolefin, polyether, polyphenylene, polyphosphazene, polysiloxane, polystyrene, polysulfide, polysulfone, polyurethane, polyurea, polyvinyl, and other polymers in total are referred to as the "characteristic chemical bonds."

Further, the term "same kind of resin" in a case where the resin is a copolymer indicates resins which commonly have a characteristic chemical bond in a case where a monomer species having the chemical bond as the structural unit in the chemical structures of a plurality of monomer species constituting the copolymer. Therefore, resins are regarded as the same kind of resin as long as they commonly have a characteristic chemical bond even in a case where the resins themselves have different properties from each other or a case where the molar component ratio of the monomer species constituting the copolymer are different from each other.

For example, a resin (or a resin unit) formed by styrene, butyl acrylate, and acrylic acid and a resin (or a resin unit) formed by styrene, butyl acrylate, and methacrylic acid have at least the chemical bond constituting polyacryl, and thus these are the same kind of resin. For another example, a resin (or a resin unit) formed by styrene, butyl acrylate, and acrylic acid and a resin (or a resin unit) formed by styrene, butyl acrylate, acrylic acid, terephthalic acid, and fumaric acid have at least the chemical bond constituting polyacryl as the chemical bond which they commonly have. Therefore, these are the same kind of resin.

The resin component constituting the amorphous resin unit is not particularly limited, but examples thereof include a vinyl resin unit, a urethane resin unit, and a urea resin unit. Among these, a vinyl resin unit is preferable for the reason that thermoplasticity is easily controlled.

The vinyl resin unit is not particularly limited as long as it is one obtained by polymerizing a vinyl compound, but examples thereof include an acrylic acid ester resin unit, a styrene-acrylic acid ester resin unit, and an ethylene-vinyl acetate resin unit. These may be used alone or in combination of two or more kinds thereof.

Among the vinyl resin units, a styrene-acrylic acid ester resin unit (styrene-acrylic resin unit) is preferable in consideration of the plasticity at the time of heat fixing. Thereafter, hereinafter, the styrene-acrylic resin unit as the amorphous resin unit will be described.

The styrene-acrylic resin unit is formed by addition polymerization of at least a styrene monomer and a (meth) acrylic acid ester monomer. The styrene monomer described herein includes those which have a structure having a well-known side chain or functional group in the styrene structure in addition to styrene represented by structural formula of $CH_2{=}CH{-}C_6H_5$. In addition, the (meth) acrylic acid ester monomer described herein includes those which have a well-known side chain or functional group in the structure of an acrylic acid ester derivative, a methacrylic acid ester derivative, or the like in addition to an acrylic acid ester compound or a methacrylic acid ester compound represented by $CH_2{=}CHCOOR$ (R is an alkyl group).

Hereinafter, specific examples of the styrene monomer and the (meth)acrylic acid ester monomer which can form the styrene-acrylic resin unit are described, but those that can be used in the formation of the styrene-acrylic resin unit to be used in the present invention are not limited to those described below.

First, specific examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. These styrene monomers can be used alone or in combination of two or more kinds thereof.

Further, specific examples of the (meth)acrylic acid ester monomer include an acrylic acid ester monomer such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, or phenyl acrylate; and a methacrylic acid ester such as methyl methacrylate, ethyl methacrylate, n-butyl methacrylate, isopropyl methacrylate, isobutylmethacrylate, t-butyl methacrylate, n-octyl methacrylate, 2-ethylhexyl methacrylate, stearyl methacrylate, lauryl methacrylate, phenyl methacrylate, diethylaminoethyl methacrylate, or dimethylaminoethyl methacrylate. Among these, from the viewpoint that the hybrid resin easily forms a lamellar structure in the inside of the toner particle, a long-chain acrylic acid ester monomer is preferably used. Specifically, n-butyl acrylate and 2-ethylhexyl acrylate are preferable.

Incidentally, in the present specification, the term "(meth) acrylic acid ester monomer" is a general term of the "acrylic acid ester monomer" and the "methacrylic acid ester monomer," and for example, the term "methyl (meth)acrylate" is a general term of "methyl acrylate" and "methyl methacrylate."

These acrylic acid ester monomers or methacrylic acid ester monomers can be used alone or in combination of two or more kinds thereof. That is, it is possible to form a copolymer by using a styrene monomer and two or more kinds of acrylic acid ester monomers, to form a copolymer by using a styrene monomer and two or more kinds of methacrylic acid ester monomers, or to form a copolymer by concurrently using a styrene monomer, an acrylic acid ester monomer, and a methacrylic acid ester monomer.

The content of the structural unit derived from a styrene monomer in the amorphous resin unit is preferably 40 to 90% by mass with respect to the total amount of the amorphous resin unit. In addition, the content of the structural unit derived from a (meth)acrylic acid ester monomer in the amorphous resin unit is preferably 10 to 60% by mass with respect to the total amount of the amorphous resin unit.

Further, the amorphous resin unit is preferably formed by addition polymerization of a compound for being chemically bonded to the crystalline polyester resin unit in addition to the styrene monomer and the (meth) acrylic acid ester monomer. Specifically, it is preferable to use a compound which forms an ester bond with the hydroxyl group [—OH] derived from a polyhydric alcohol or the carboxy group [—COOH] derived from a polycarboxylic acid contained in the crystalline polyester resin unit. Therefore, the amorphous resin unit is preferably formed by further polymerizing a compound which is capable of being addition-polymerized to the styrene monomer and the (meth) acrylic acid ester monomer and has a carboxy group [—COOH] or a hydroxyl group [—OH].

Examples of such a compound include a compound having a carboxyl group such as acrylic acid, methacrylic acid, maleic acid, itaconic acid, cinnamic acid, fumaric acid, maleic acid monoalkyl ester, or itaconic acid monoalkyl ester; and a compound having a hydroxyl group such as 2-hydroxyethyl 3-hydroxypropyl (meth) acrylate, 2-hydroxybutyl (meth) acrylate, 3-hydroxybutyl (meth) acrylate, 4-hydroxybutyl (meth)acrylate, or polyethylene glycol mono(meth)acrylate.

The content of the structural unit derived from the above-described compound in the amorphous resin unit is preferably 0.5 to 20% by mass with respect to the total amount of the amorphous resin unit.

The method for forming the styrene-acrylic resin unit is not particularly limited, and a method in which monomers are polymerized using a well-known oil-soluble or water-soluble polymerization initiator is exemplified. Specific examples of the oil-soluble polymerization initiator include azo-based or diazo-based polymerization initiators or peroxide-based polymerization initiators to be described below.

Examples of the azo-based or diazo-based polymerization initiator include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

Examples of the peroxide-based polymerization initiator include benzoyl peroxide, methylethyl ketone peroxide, diisopropyl peroxy carbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, and tris-(t-butylperoxy)triazine.

Further, in a case where resin particles are formed by an emulsion polymerization method, a water-soluble radical polymerization initiator can be used. Examples of the water-soluble radical polymerization initiator include a persulfuric acid salt such as potassium persulfate or ammonium persulfate, an azobisaminodipropane acetic acid salt, azobiscyanovaleric acid and a salt thereof, and hydrogen peroxide.

The content of the amorphous resin unit is preferably 3% by mass or more and less than 15% by mass with respect to the total amount of the hybrid resin. Further, the content thereof is more preferably 5% by mass or more and less than 10% by mass. When the content thereof is set within the above ranges, sufficient crystallinity can be imparted to the hybrid resin.

((Method for Producing Hybrid Crystalline Polyester Resin))

The method for producing the hybrid resin contained in the binder resin according to the present invention is not particularly limited as long as it is a method by which a polymer having a structure of which chemically bonding the crystalline polyester resin unit and the amorphous resin unit can be formed. Specific examples of the method for producing the hybrid resin include methods to be described below.

(a) Method for producing a hybrid resin in which an amorphous resin unit is polymerized in advance and a crystalline polyester resin unit is formed by performing polymerization reaction in the presence of the amorphous resin unit In this method, first, the amorphous resin unit is formed by subjecting a monomer (preferably, vinyl monomers such as a styrene monomer and a (meth)acrylic acid ester monomer) constituting the amorphous resin unit described above to addition reaction. Next, the crystalline polyester resin unit is formed by subjecting polycarboxylic acid and polyhydric alcohol to polymerization reaction in the presence of the amorphous resin unit. At this time, the hybrid resin is formed by subjecting the polycarboxylic acid and the polyhydric alcohol to condensation reaction and subjecting the polycarboxylic acid or the polyhydric alcohol to addition reaction with the amorphous resin unit.

In the above method, it is preferable that a moiety through which these units can react with each other be incorporated into the crystalline polyester resin unit or the amorphous resin unit. Specifically, at the time of forming the amorphous resin unit, a compound which has a moiety capable of reacting with the carboxyl group [—COOH] or hydroxyl group [—OH] which remains in the crystalline polyester resin unit and a moiety capable of reacting with the amorphous resin unit is used in addition to the monomer constituting the amorphous resin unit. That is, when this compound reacts with the carboxyl group [—COOH] or hydroxyl group [—OH] in the crystalline polyester resin unit, the crystalline polyester resin unit can be chemically bonded to the amorphous resin unit.

Alternatively, at the time of forming the crystalline polyester resin unit, a compound which has a moiety capable of reacting with the polyhydric alcohol or the polycarboxylic acid and a moiety capable of reacting with the amorphous resin unit may be used.

When the above-described method is used, the hybrid resin having a structure in which the crystalline polyester resin unit is molecularly bonded to the amorphous resin unit (graft structure).

(b) Method for producing a hybrid resin in which a crystalline polyester resin unit and an amorphous resin unit are respectively formed and these resin units are bonded to each other In this method, first, the crystalline polyester resin unit is formed by subjecting polycarboxylic acid and polyhydric alcohol to condensation reaction. In addition, the amorphous resin unit is formed by subjecting the monomer constituting the amorphous resin unit described above to addition polymerization separately from the reaction system forming the crystalline polyester resin unit. At this time, it is preferable that a moiety through which the crystalline polyester resin unit and the amorphous resin unit can react with each other be incorporated thereinto. Incidentally, a method for incorporating such a moiety capable of reacting is as described above, and thus the detailed description thereof is omitted.

Next, it is possible to form a hybrid resin having a structure in which the crystalline polyester resin unit is molecularly bonded to amorphous resin unit by reacting the crystalline polyester resin unit and the amorphous resin unit, which are formed above.

Furthermore, in a case where the reactive moiety described above is not incorporated into the crystalline polyester resin unit and the amorphous resin unit, it is also possible to employ a method in which a system in which the crystalline polyester resin unit and the amorphous resin unit coexist is formed and a compound, which has a moiety capable of bonding to the crystalline polyester resin unit and the amorphous resin unit, is introduced to the system. Then, it is possible to forma hybrid resin having a structure in which the crystalline polyester resin unit is molecularly bonded to the amorphous resin unit via the compound.

(c) Method for forming a hybrid resin in which a crystalline polyester resin unit is formed in advance and an amorphous resin unit is formed by polymerization reaction in the presence of the crystalline polyester resin unit In this method, first, the crystalline polyester resin unit is formed by subjecting polycarboxylic acid and polyhydric alcohol to condensation reaction. Next, the amorphous resin unit is formed by subjecting a monomer constituting the amorphous resin unit to polymerization reaction in the presence of the crystalline polyester resin unit. At this time, it is preferable that a moiety through which these units can react with each other be incorporated into the crystalline polyester resin unit or the amorphous resin unit in the same manner as in above (1). Incidentally, a method for incorporating such a moiety capable of reacting is as described above, and thus the detailed description thereof is omitted.

When the above-described method is used, it is possible to form a hybrid resin having a structure in which the crystalline polyester resin unit is molecularly bonded to the amorphous resin unit (graft structure).

Among the above-described formation methods (a) to (c), since a hybrid resin having a structure in which the crystalline polyester resin chain is grafted to the amorphous resin chain is easily formed and the production process can be simplified, the method (a) is preferable. Since the amorphous resin unit is formed in advance and the crystalline polyester resin unit is then bonded thereto in the method (a), the orientation of the crystalline polyester resin unit is likely to be uniform. Therefore, the method (a) is preferable since it is possible to reliably form a hybrid resin suitable for the toner defined in the present invention.

(Binder Resin Other than Crystalline Polyester Resin)

The binder resin other than a crystalline polyester resin is not particularly limited, a vinyl resin, a urethane resin, a urea resin, or the like can be used, and an amorphous polyester resin such as a styrene-acrylic modified polyester resin may be used. In addition, it is preferable to contain a resin component constituting the unit described in the above section ((Amorphous Resin Unit Other Than Polyester Resin)). The binder resin other than a crystalline polyester resin is preferably an amorphous resin. Hereinafter, the amorphous resin as the binder resin other than a crystalline polyester resin will be described.

The amorphous resin is preferably configured by the same kind of resin as the amorphous resin unit in the hybrid resin. Here, the expression "configured by the same kind of resin" means that it may have a form that is composed of only the same kind of resin or a form that is not only composed of the same kind of resin but also contains another amorphous resin. However, in the case of the form that contains the same kind of resin and another amorphous resin, the content of the same kind of resin is preferably 15% by mass or more and more preferably 20% by mass or more with respect to the total amount of the amorphous resin.

Further, the amorphous resin may be a copolymer which has a unit derived from the same kind of resin as the amorphous resin unit in the hybrid resin and a unit derived from another amorphous resin. At this time, the copolymer may be any of a block copolymer, a graft copolymer, or the like, but it is preferably a graft copolymer from the viewpoint of easily controlling the compatibility with the hybrid resin. However, in this case, the content of the unit derived from the same kind of resin as the amorphous resin unit in the hybrid resin is preferably 15% by mass or more and more preferably 20% by mass or more with respect to the total amount of the amorphous resin.

Incidentally, the definition of the "same kind of resin" is described in the above section ((Amorphous Resin Unit Other Than Polyester Resin)), and thus the detailed description thereof is omitted.

As binder resin other than a crystalline polyester resin, among the above resins, a vinyl resin or a styrene-acrylic modified polyester resin is preferable, and a vinyl resin is particularly preferable. Regarding a vinyl resin and a styrene-acrylic modified polyester resin, the compatibility with the hybrid resin is easily controlled particularly in a case where the amorphous resin unit in the hybrid resin is a vinyl resin unit.

From the viewpoint of easily controlling the plasticity of the binder resin other than a crystalline polyester resin, the weight average molecular weight (Mw) thereof is preferably 5,000 to 150,000 and more preferably 10,000 to 70,000. The glass transition temperature (Tg) of the binder resin other than a crystalline polyester resin is preferably 25 to 70° C.

(Vinyl Resin)

The vinyl resin is not particularly limited as long as it is obtained by polymerization of a vinyl compound, and examples thereof include an acrylic acid ester resin, a styrene-acrylic acid ester resin, and an ethylene-vinyl acetate resin. These may be used alone or in combination of two or more kinds thereof. Among the above vinyl resins, in consideration of the plasticity at the time of heat fixing, a styrene-acrylic acid ester resin (styrene-acrylic copolymer) is preferable. When a long-chain acrylic acid ester having high hydrophobicity is used as the monomer species, the localization of the crystalline polyester resin having a lamellar structure on the surface of the toner particle can be prevented and the position of the crystalline polyester resin can be controlled to be the inside of the toner particle.

((Styrene-Acrylic Copolymer))

The styrene-acrylic copolymer described in the present invention is formed by performing polymerization using at least a styrene monomer and a (meth) acrylic acid ester monomer. Here, the styrene monomer includes those which have a structure having a well-known side chain or functional group in the styrene structure in addition to styrene represented by structural formula of $CH_2{=}CH{-}C_6H_5$.

In addition, the (meth)acrylic acid ester monomer is one having a functional group having an ester bond in the side chain. Specifically, a vinyl-based ester compound such as a methacrylic acid ester monomer represented by $CH_2{=}C(CH_3)COOR$ (R is an alkyl group) is included in addition to an acrylic acid ester monomer represented by $CH_2{=}CHCOOR$ (R is an alkyl group).

Hereinafter, specific examples of the styrene monomer and the (meth)acrylic acid ester monomer which can form the styrene-acrylic copolymer are described, but are not limited to those described below.

Examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene.

Further, representative examples of the (meth)acrylic acid ester monomer include an acrylic acid ester monomer and a methacrylic acid ester monomer which are described below, and examples of the acrylic acid ester monomer include methyl acrylate, ethyl acrylate, n-propyl acrylate, isopropyl acrylate, n-butyl acrylate, isobutyl acrylate, t-butyl acrylate, n-octyl acrylate, 2-ethylhexyl acrylate, stearyl acrylate, lauryl acrylate, and phenyl acrylate. Examples of the methacrylic acid ester monomer include methyl methacrylate, ethyl methacrylate, n-propyl methacrylate, isopropyl methacrylate, n-butyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate.

These styrene monomers, acrylic acid ester monomers, or methacrylic acid ester monomers can be used alone or in combination of two or more kinds thereof.

Further, in addition to the copolymer formed by only the styrene monomer and the (meth) acrylic acid ester monomer described above, in the styrene-acrylic copolymer, there are also those which are formed by using a general vinyl monomer together with these styrene monomer and (meth) acrylic acid ester monomer. Hereinafter, examples of the vinyl monomer which can be concurrently used in formation of the styrene-acrylic copolymer described in the present invention are described, but the vinyl monomer which can be concurrently used is not limited to those described below.

(1) Olefins

Ethylene, propylene, isobutylene, and the like (2) Vinyl Ethers

Vinyl propionate, vinyl acetate, vinyl benzoate, and the like (3) Vinyl Ethers

Vinyl methyl ether, vinyl ethyl ether, and the like (4) Vinyl Ketones

Vinyl methyl ketone, vinyl ethyl ketone, vinyl hexyl ketone, and the like (5) N-Vinyl Compounds N-vinylcarbazole, N-vinylindole, N-vinylpyrrolidone, and the like (6) Others Vinyl compounds such as vinyl naphthalene and vinyl pyridine, and acrylic or methacrylic derivatives such as acrylonitrile, methacrylonitrile, and acrylamide In addition, a resin having a crosslinking structure can be produced by using polyfunctional vinyl monomers to be described below. Specific examples of the polyfunctional vinyl monomers include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, and neopentyl glycol diacrylate.

Further, a vinyl monomer having an ionic leaving group in the side chain as described below can also be used. Specific examples of the ionic leaving group include a carboxy group, a sulfonic acid group, and a phosphate group. Hereinafter, specific examples of vinyl monomers having these ionic leaving groups are described.

Specific examples of a vinyl monomer having a carboxy group include acrylic acid, methacrylic acid, maleic acid, itaconic acid, cinnamic acid, fumaric acid, maleic acid monoalkyl ester, and itaconic acid monoalkyl ester.

Further, specific examples of a vinyl monomer having a sulfonic acid group include styrene sulfonic acid, allyl sulfosuccinic acid, and 2-acrylamide-2-methylpropane sulfonic acid. In addition, examples of a vinyl monomer having a phosphate group include acid phosphoxyethyl methacrylate and 3-chloro-2-acid phosphoxypropyl methacrylate.

The method for forming the styrene-acrylic copolymer is not particularly limited, and a method of polymerizing a monomer by using a well-known oil-soluble or water-soluble polymerization initiator is exemplified. Specific examples of the oil-soluble or water-soluble polymerization initiator are the same as described in the above section <Styrene-Acrylic Modified Polyester Resin>, and thus the description is omitted here.

In a case where the styrene-acrylic copolymer used in the present invention is formed, the contents of the styrene monomer and the acrylic acid ester monomer are not particularly limited, and can be appropriately adjusted from the viewpoint of adjusting the softening point temperature and the glass transition temperature of the binder resin. Specifically, the content of the styrene monomer is preferably 40 to 95% by mass and more preferably 50 to 80% by mass with respect to the total monomers. In addition, the content of the acrylic acid ester monomer is preferably 5 to 60% by mass and more preferably 10 to 50% by mass with respect to the total monomers.

The molecular weight of the styrene-acrylic copolymer is preferably 2,000 to 1,000,000 in terms of the weight average molecular weight (Mw). In addition, the number average molecular weight (Mn) is preferably 1,000 to 100,000. Further, the molecular weight distribution (Mw/Mn) is preferably 1.5 to 100 and more preferably 1.8 to 70. When the weight average molecular weight (Mw), the number average molecular weight (Mn), and the molecular weight distribution (Mw/Mn) of the styrene-acrylic copolymer are set in the above ranges, occurrence of offset phenomenon in the fixing step is effectively prevented when preparation of prints is performed by using the produced toner. In addition, the glass transition temperature of the styrene-acrylic copolymer to be formed by radical polymerization is preferably 30 to 70° C., and the softening point temperature is preferably 80 to 170° C. When the glass transition temperature and the softening point temperature are set in the above ranges, favorable fixability can be obtained.

Incidentally, the number average molecular weight (Mn) and the weight average molecular weight (Mw) of the binder resin constituting the toner can be calculated by a molecular weight measurement method. Hereinafter, a molecular weight measurement procedure which is performed by gel permeation chromatography (GPC) using tetrahydrofuran (THF) as a column solvent, as a representative example of the molecular weight measurement method, will be described.

Specifically, 1 ml of THF (degassed THF is used) is added to 1 mg of a measurement sample, and stirring treatment is performed at room temperature using a magnetic stirrer for sufficient dissolution. Next, filtration is performed using a membrane filter having a pore size of 0.45 μm to 0.50 μm, and then the resultant solution is injected into a GPC device.

As the measurement conditions of GPC, measurement is carried out in such a manner that the column is stabilized at 40° C., THF is allowed to flow at a flow rate of 1 ml/min, and 100 μl of a sample with a concentration of 1 mg/ml is injected. The column is preferably used in a combination of commercially available polystyrene gel columns. For example, the column is a combination of columns selected from Shodex GPC KF-801, 802, 803, 804, 805, 806, and 807 manufactured by SHOWA DENKO K.K. or a combination of columns selected from TSKgel G1000H, G2000H, G3000H, G4000H, G5000H, G6000H, G7000H, GMHXL, and TSK guard column manufactured by Tosoh Corporation.

As a detector, a refractive index detector (RI detector) or a UV detector is preferably used. In the molecular weight measurement of a sample, the molecular weight distribution of the sample is calculated by use of a calibration curve created using monodisperse polystyrene standard particles. As polystyrene for creating the calibration curve, it is preferable to use about 10 standard polystyrene samples.

The molecular weight measurement can be performed, for example, under the following measurement conditions.

(Measurement Conditions)

Device: HLC-8020 (manufactured by Tosoh Corporation)

Column: GMHXL×2, G2000HXL×1

Detector: at least one of RI and UV detectors

Flow rate of eluate: 1.0 ml/min

Sample concentration: 0.01 g/20 ml

Sample amount: 100 μl

Calibration curve: calibration curve prepared using standard polystyrene (Styrene-Acrylic Modified Polyester Resin)

A styrene-acrylic modified polyester resin may be used as the binder resin. The "styrene-acrylic modified polyester resin" indicates a resin composed of a polyester molecule having a structure in which a styrene-acrylic copolymer molecular chain (hereinafter, also referred to as a styrene-acrylic copolymer segment) is chemically bonded to a polyester molecular chain (hereinafter, also referred to as a polyester segment). That is, the styrene-acrylic modified polyester resin is a resin having a copolymer structure in which the styrene-acrylic copolymer segment is covalently bonded to the polyester segment.

Here, the styrene-acrylic modified polyester resin is clearly differentiated from the hybrid resin in terms of the points described below. That is, the polyester segment constituting an amorphous styrene-acrylic modified polyester resin is different from the crystalline polyester resin unit constituting the hybrid resin, and is an amorphous molecular chain that does not have a clear melting point and has a relatively high glass transition temperature (Tg). Such a point can be confirmed by performing differential scanning calorimetry (DSC) on the toner. In addition, since a monomer (chemical structure) constituting the polyester segment is different from a monomer (chemical structure) constituting the crystalline polyester resin unit, differentiation can also be made by, for example, analysis such as NMR.

The polyester segment is formed by a polyhydric alcohol component and a polycarboxylic acid component.

The polyhydric alcohol component is not particularly limited, but from the viewpoint of chargeability and toner strength, an aromatic diol or a derivative thereof is preferable. Examples thereof may include bisphenols such as bisphenol A and bisphenol F and alkylene oxide adduct of bisphenols such as ethylene oxide adducts and propylene oxide adducts thereof.

Among these, particularly from the viewpoint of improving the electrification property of the toner, an ethylene oxide adduct and a propylene oxide adduct of bisphenol A is preferably used as a polyhydric alcohol component. These polyhydric alcohol components may be used alone or in combination of two or more kinds thereof.

Examples of the polycarboxylic acid component, which is condensed with the polyhydric alcohol component, include aromatic carboxylic acids such as terephthalic acid, isophthalic acid, phthalic anhydride, trimellitic anhydride, pyromellitic acid, and naphthalene dicarboxylic acid; aliphatic carboxylic acids such as fumaric acid, maleic anhydride, and alkenyl succinic acid; lower alkyl esters and acid anhydrides of these acids. One or two or more kinds of these can be used.

The method for forming the polyester segment is not particularly limited, and the polyester segment can be produced by the same method for forming the crystalline polyester resin unit described in the above section ((Crystalline Polyester Resin Unit)).

The styrene-acrylic copolymer segment is a molecular chain derived from the same monomer as the styrene-acrylic resin unit described in the above section ((Amorphous Resin Unit Other Than Polyester Resin)). Therefore, the detailed descriptions of the kinds of the monomer constituting the segment, the configuration ratio, the method for forming the segment, and the like are omitted.

The content of the polyester segment in the styrene-acrylic modified polyester resin is preferably 40 to 90% by mass with respect to the total amount of the styrene-acrylic modified polyester resin. Further, the content of the styrene-acrylic copolymer segment in the styrene-acrylic modified polyester resin is preferably 10 to 60% by mass with respect to the total amount of the styrene-acrylic modified polyester resin. When the content is set within such a range, the plasticity of the styrene-acrylic modified polyester resin is easily controlled.

(Other Binder Resins)

The binder resin of the present invention may contain other resins in addition to the above-described resin. Examples of the other resins include homopolymers of styrene or a styrene derivative such as polystyrene, poly p-chlorostyrene, and polyvinyl toluene; styrene-based copolymers such as a styrene-p-chlorostyrene copolymer, a styrene-propylene copolymer, a styrene-vinyl toluene copolymer, a styrene-vinyl naphthalene copolymer, a styrene-acrylonitrile copolymer, a styrene-vinyl methyl ketone copolymer, a styrene-butadiene copolymer, a styrene-isoprene copolymer, a styrene-butadiene-acrylonitrile copolymer, a styrene-acrylonitrile-indene copolymer, a styrene-maleic acid copolymer, and a styrene-maleic acid ester copolymer; polymethyl methacrylate; polybutyl methacrylate; polyvinyl chloride; polyvinyl acetate; polyethylene; polypropylene; epoxy resins; epoxy polyol resins; polyurethane; polyamide; polyvinyl butyral; polyacrylic acid resins; rosins; modified rosins; terpene resins; aliphatic or alicyclic hydrocarbon resins; aromatic petroleum resins; chlorinated paraffin; and paraffin waxes. These other resins can be used alone or in combination of two or more kinds thereof.

(Core-Shell Structure)

The toner base particles configured by containing a binder resin may have a single-layer structure or a core-shell structure, but although not particularly limited, preferably have a core-shell structure. The toner base particles are particles containing at least a binder resin, and as necessary, containing a colorant or other additives (internal additives). Preferably, toner particles (a toner) are completed by adding an external additive, as necessary, to the toner base particles.

The core-shell structure has a resin region (shell) with a relatively high glass transition temperature on the resin particle (core particle) surface which contains a colorant, a wax or the like and has a relatively low glass transition temperature. The core-shell structure is not limited to a structure in which the shell completely covers the core, and for example, a structure in which the shell does not completely cover the core particles and the core particles are exposed in places is included.

The cross-sectional structure of the core-shell structure can be confirmed by means of a well-known means such as a transmission electron microscope (TEM) or a scanning probe microscope (SPM). Here, the method for observing the cross-sectional structure of the toner particle with a transmission electron microscope (TEM) will be described. The observation of the cross-sectional structure of the toner particle with a transmission electron microscope is performed according to the following procedures, for example.

First, the toner particles are sufficiently dispersed in a normal temperature-curable epoxy resin and are embedded, the resultant is dispersed in styrene fine powder having a particle diameter of about 100 nm, and then pressure molding is performed to thereby produce a block containing the toner particles. Subsequently, the produced block is subjected to staining treatment using ruthenium tetroxide or osmium tetroxide if necessary, and then the block is cut in the flaky shape having a thickness of 60 to 200 nm with a microtome equipped with diamond teeth to thereby produce a sample for measurement.

Next, the flaky sample for measurement is set on a transmission electron microscope (TEM) and the cross-sectional structure of the toner particle is photographed. The magnification of the electronic microscope is preferably such a magnification that the cross-section of one toner particle is in the field of view, and specifically, is preferably about 10,000 folds. In addition, the number of the toner particles to be photographed is preferably 10 or more.

The types of equipment which is generally known by a person skilled in the art can sufficiently cope with the observation of the cross-sectional structure of the toner particle with a transmission electron microscope, and specific examples of the types of equipment include "LEM-2000 Type (manufactured by TOPCON CORPORATION)" and "JEM-2000FX (manufactured by JEOL Ltd.)."

Further, the coverage of the shell on the core surface can be calculated by electronic microscope observation. That is, the coverage can be calculated in such a manner that information on an image photographed by a transmission electron microscope (TEM) is subjected to arithmetic processing by, for example, a commercially available image processing apparatus "Luzex (trademark) F" (manufactured by NIRECO CORPORATION), and the coverage is calculated from areas of the core region and the shell region of the photographed toner particle. In addition, the average coverage of the shell is obtained by using photographs of the cross-sectional structures of at least ten toner particles.

The combination of resins constituting the core-shell structure is not particularly limited, but it is preferable that a styrene-acrylic copolymer be used as a core portion and a polyester resin or a styrene-acrylic modified polyester resin be used as a shell portion. Furthermore, when the styrene-acrylic copolymer is used as a core portion, the affinity with the styrene-acrylic copolymer is further increased. For this reason, the styrene-acrylic modified polyester resin is more preferably used as a shell portion.

When the shell portion is formed by the styrene-acrylic modified polyester resin, the shell can uniformly adhere to the surface of the core particle containing the styrene-acrylic copolymer without unevenness. That is, due to the presence of a styrene-acrylic copolymer molecular chain bonded to a polyester molecular chain, the resin of the shell portion exhibits affinity with respect to the core particle containing the styrene-acrylic copolymer, and thus the resin of the shell portion adheres to any portions on the core particle surface with the same probability. As a result, the resin of the shell portion can adhere to the core particle surface with a uniform thickness without unevenness. Further, the toner particles of the core-shell structure in which the core particle surface is uniformly covered with the shell without unevenness can achieve both the low temperature fixability and the heat-resistant storage property.

Further, it is considered that, when the styrene-acrylic copolymer molecule is allowed to be present in the shell portion, the resin particles for shell exhibits proper dispersibility at the time of forming the shell, and thin and uniform shell is formed on the core particle surface. That is, it is considered that, due to the presence of the styrene-acrylic copolymer molecule, the affinity between the polyester molecular chains is decreased, the aggregation of the resin particles for shell is avoided, and the environment where the resin particles adhere to the core particle surface with a distance between the resin particles is created.

Furthermore, in a case where the shell portion has the styrene-acrylic modified polyester resin, when the shell is formed, a thin layer shell which has a uniform thickness and a smooth surface can be more reliably formed, and thus the toner in which both the heat-resistant storage property and the low temperature fixability are achieved can be more reliably produced. At this time, in order to form the polyester segment, aliphatic unsaturated dicarboxylic acid is preferably used. The reason for this is considered that, due to a carbon-carbon unsaturated bond derived from aliphatic unsaturated dicarboxylic acid, the environment where the polyester resin particles easily adhere to the core particle surface containing the styrene-acrylic resin is created.

Among the styrene-acrylic modified polyester resins, those which have a block copolymer structure in which the styrene-acrylic copolymer molecular chain is bonded to the polyester molecular chain terminal are likely to forma shell portion of a phase-separated structure in which a polyester phase and a styrene-acrylic copolymer phase are independent to each other and are preferable in terms of the formation of a functional-separated type shell portion. That is, it is possible to efficiently exhibit improvement in heat-resistant imparting performance by a high glass transition temperature and softening point due to the polyester phase and adhesion strength with the core particles due to the styrene-acrylic copolymer phase.

The content ratio of the resin for shell in the binder resin constituting the core-shell type toner particles to be produced in the present invention is preferably 5 to 50% by mass and more preferably 10 to 40% by mass with respect to the total amount of the binder resin. When the content ratio of the resin for shell is set to be in the above ranges, such an amount of the resin for shell that is covered to the entire core particle surface is supplied, which is preferable in terms of the formation of the toner in which both the heat-resistant storage property and the low temperature fixability are achieved.

The content ratio of the styrene acrylic-modified polyester in the resin used in the shell portion (resin for shell) is preferably 70 to 100% by mass and more preferably 90 to 100% by mass with respect to 100% by mass of the resin for shell. When the content ratio of the styrene acrylic-modified polyester in the resin for shell is set to be in the above ranges, the affinity between the core particles and the shell is easily secured, sufficient heat-resistant storage property is obtained, and effects of improving chargeability and shatter resistance are also obtained.

From the viewpoint of fixability such as low temperature fixability or fixing separation property and from the viewpoint of heat resistance such as heat-resistant storage property or blocking resistance, the glass transition temperature of the resin used in the shell portion is preferably 50 to 70° C. and more preferably 50 to 65° C. In addition, from the same viewpoints, the softening point temperature is preferably 80 to 110° C.

The glass transition temperature of the resin used in the shell portion can be measured by, for example, a method defined by ASTM (American Society for Testing and Materials) D3418-82 (DSC method).

[Release Agent]

The toner of the present invention contains a release agent. As the release agent (offset inhibitor), hydrocarbon waxes, ester waxes, natural-substance-based waxes, amide-based waxes, and the like are exemplified. In the toner of the present invention, it is preferable that the release agent contain an ester wax or a hydrocarbon wax. These release agents are suitable for the toner of the present invention, and when these release agents are used, the fixing separation property of the toner can be improved.

Examples of the hydrocarbon waxes include microcrystalline waxes, Fischer-Tropsch waxes, and paraffin waxes in addition to polyethylene waxes and polypropylene waxes with a low molecular weight.

Examples of the ester waxes include esters of higher fatty acid and higher alcohols such as behenyl behenate, ethylene glycol stearic acid ester, ethylene glycol behenic acid ester, neopentyl glycol stearic acid ester, neopentyl glycol behenic acid ester, 1,6-hexanediol stearic acid ester, 1,6-hexanediol behenic acid ester, glycerol stearic acid ester, glycerol behenic acid ester, pentaerythritol tetrastearic acid ester, pentaerythritol tetrabehenic acid ester, stearyl citrate, behenyl citrate, stearyl malate, and behenyl malate. These release agents can be used alone or in combination of two or more kinds thereof.

The melting point of the release agent is preferably 40 to 160° C. and more preferably 60 to 100° C. When the melting point thereof is set to be in the above ranges, the heat-resistant storage property of the toner is secured and a toner image forming can stably be performed without cold offset or the like even when fixing is performed at low temperature. Further, the content of the release agent in the toner base particles is preferably 1 to 30% by mass and more preferably 5 to 20% by mass.

The acid value of the release agent is preferably 0.1 to 10 mgKOH/g. Further, it is preferable that the acid value of the crystalline polyester resin be different from the acid value of the release agent. Furthermore, it is preferable that the acid value of the crystalline polyester resin be larger than the acid value of the release agent. When the acid value of the release agent is in the above range, the crystalline polyester resin is likely to form a lamellar structure on the inside of the toner particle, which is favorable. In addition, also when the acid value of the crystalline polyester resin is larger than the acid value of the release agent, the crystalline polyester resin is likely to form a lamellar structure on the inside of the toner particle, which is favorable.

[Colorant]

In the present invention, a colorant can be used in order to produce a color toner. Examples of usable colorants include well-known inorganic or organic colorants. Hereinafter, specific examples of the colorants are described.

Examples of a black colorant include carbon blacks such as furnace black, channel black, acetylene black, thermal black, and lampblack, and the magnetic powder such as magnetite or ferrite.

Examples of colorants for magenta or red include C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 60, C. I. Pigment Red 63, C. I. Pigment Red 64, C. I. Pigment Red 68, C. Pigment Red 81, C. I. Pigment Red 83, C. I. Pigment Red 87, C. I. Pigment Red 88, C. I. Pigment Red 89, C. I. Pigment Red 90, C. I. Pigment Red 112, C. I. Pigment Red 114, C. I. Pigment Red 122, C. I. Pigment Red 123, C. I. Pigment Red 139, C. I. Pigment Red 144, C. I. Pigment Red 149, C. I. Pigment Red 150, C. I. Pigment Red 163, C. I. Pigment Red 166, C. I. Pigment Red 170, C. I. Pigment Red 177, C. I. Pigment Red 178, C. I. Pigment Red 184, C. I. Pigment Red 202, C. I. Pigment Red 206, C. I. Pigment Red 207, C. I. Pigment Red 209, C. I. Pigment Red 222, C. I. Pigment Red 238, and C. I. Pigment Red 269.

Further, examples of colorants for orange or yellow include C. I. Pigment Orange 31, C. I. Pigment Orange 43, C. I. Pigment Yellow 12, C. I. Pigment Yellow 14, C. I. Pigment Yellow 15, C. I. Pigment Yellow 17, C. I. Pigment Yellow 74, C. I. Pigment Yellow 83, C. I. Pigment Yellow 93, C. I. Pigment Yellow 94, C. I. Pigment Yellow 138, C. I. Pigment Yellow 155, C. I. Pigment Yellow 162, C. I. Pigment Yellow 180, and C. I. Pigment Yellow 185.

Furthermore, examples of colorants for green or cyan include C. I. Pigment Blue 2, C. I. Pigment Blue 3, C. I. Pigment Blue 15, C. I. Pigment Blue 15:2, C. I. Pigment Blue 15:3, C. I. Pigment Blue 15:4, C. I. Pigment Blue 16, C. I. Pigment Blue 17, C. I. Pigment Blue 60, C. I. Pigment Blue 62, C. I. Pigment Blue 66, and C. I. Pigment Green 7.

Further, examples of dyes include C. I. Solvent Red 1, C. I. Solvent Red 49, C. I. Solvent Red 52, C. I. Solvent Red 58, C. I. Solvent Red 63, C. I. Solvent Red 111, C. I. Solvent Red 122, C. I. Solvent Yellow 2, C. I. Solvent Yellow 6, C. I. Solvent Yellow 14, C. I. Solvent Yellow 15, C. I. Solvent Yellow 16, C. I. Solvent Yellow 19, C. I. Solvent Yellow 21, C. I. Solvent Yellow 33, C. I. Solvent Yellow 44, C. I. Solvent Yellow 56, C. I. Solvent Yellow 61, C. I. Solvent Yellow 77, C. I. Solvent Yellow 79, C. I. Solvent Yellow 80, C. Solvent Yellow 81, C. I. Solvent Yellow 82, C. I. Solvent Yellow 93, C. I. Solvent Yellow 98, C. I. Solvent Yellow 103, C. I. Solvent Yellow 104, C. I. Solvent Yellow 112, C. I. Solvent Yellow 162, C. I. Solvent Blue 25, C. I. Solvent Blue 36, C. I. Solvent Blue 60, C. I. Solvent Blue 70, C. I. Solvent Blue 93, and C. I. Solvent Blue 95.

These colorants can be used alone or in combination of two or more kinds thereof, as necessary. In the case of the colorant, the added amount thereof is preferably 1 to 30% by mass and more preferably 2 to 20% by mass with respect to the total toner. The number average primary particle diameter of the colorant varies depending on the types of the colorant, but is preferably approximately 10 to 200 nm. Incidentally, the number average primary particle diameter of the colorant can be measured by using, for example, a microtrac particle size distribution measurement device "UPA-150" (manufactured by NIKKISO CO., LTD.).

As the colorant, those which are surface-modified can also be used. As a surface modifier therefor, those known in the related art can be used, and specifically, a silane coupling agent, a titanium coupling agent, an aluminum coupling agent, or the like can be preferably used.

[Charge Control Agent]

A charge control agent may be internally added to the toner of the present invention. As the charge control agent, it is possible to use various well-known compounds such as nigrosine-based dye, a metal salt of naphthenic acid or higher fatty acid, an alkoxylated amine, a quaternary ammonium salt compound, an azo-based metal complex, and a salicylic acid metal salt.

The added amount of the charge control agent is set to be usually 0.1 to 10% by mass and preferably 0.5 to 5% by mass with respect to 100% by mass of the binder resin in the toner particles to be finally obtained.

The size of the charge control agent particles is 10 to 1,000 nm, preferably 50 to 500 nm, and particularly preferably 80 to 300 nm in terms of the number average primary particle diameter.

[External Additive]

A well-known external additive may be used in the toner of the present invention. The external additive is not particularly limited, but inorganic fine particles having a number average primary particle diameter of about 2 to 800 nm is preferable. The types of the external additive are not particularly limited, and examples thereof include well-known inorganic fine particles and lubricants which are described below. These external additives can be used alone or in combination of two or more kinds thereof.

As the inorganic fine particles, inorganic fine particles known in the related art can be used, and preferred examples thereof include silica, titania (titanium dioxide), alumina, strontium titanate fine particles, and hydrotalcite. In addition, it is also possible to use inorganic fine particles subjected to the hydrophobization treatment as necessary.

Specific examples of silica fine particles include R-805, R-976, R-974, R-972, R-812 and R-809 which are commercially available from Nippon Aerosil Co., Ltd.; HVK-2150 and H-200 which are commercially available from Hoechst Corporation; TS-720, TS-530, TS-610, H-5 and MS-5 which is commercially available from Cabot Corporation.

Examples of titania fine particles include T-805 and T-604 which are commercially available from Nippon Aerosil Co. Ltd.; MT-100S, MT-100B, MT-500BS, MT-600, MT-600SS, JA-1 which are commercially available from Teika Corporation; TA-300SI, TA-500, TAF-130, TAF-510 and TAF-510T which as commercially available from Fuji Titanium industry Co., Ltd.; IT-S, IT-OA, IT-OB and IT-OC which as commercially available from Idemitsu Kosan Co., Ltd.

Examples of alumina fine particles include RFY—C and C-604 which are commercially available from Nippon Aerosil Co., Ltd.; and TTO-55, commercially available from Ishihara Sangyo Co., Ltd.

Lubricants are usable to improve cleaning ability and transferability. For example, the following higher fatty acid metal salts are mentioned. That is, salts such as zinc stearate, aluminum stearate, copper stearate, magnesium stearate, and calcium stearate, salts such as zinc oleate, manganese oleate, iron oleate, copper oleate, and magnesium oleate, salts such as zinc palmitate, copper palmitate, magnesium palmitate, and calcium palmitate, salts such as zinc linoleate and calcium linoleate, salts such as zinc ricinoleate and calcium ricinoleate, and the like are exemplified.

The added amount of an external additive or a lubricant other than these resin particles is preferably 0.1 to 10.0 parts by mass with respect to 100 parts by mass of the toner particles.

[Particle Diameter of Toner Particle]

The particle diameter of the toner particle included in the toner for electrostatic charge image development of the present invention is preferably 3 to 8 μm in terms of the median size (D50) on a number basis. This particle diameter can be controlled by the concentration of aggregating agent, the added amount of an organic solvent, fusion time, or the composition of a polymer itself in the production method to be described later. When the median size (D50) on a number basis is 3 to 8 μm, reproducibility of thin lines and high image quality of photographic images are achieved, and the consumed amount of the toner can be reduced as compared to the case of using a toner having a large particle diameter. Incidentally, the median size can be measured by, for example, "MULTISIZER 3" (manufactured by Beckman Coulter, Inc.).

[Average Circularity of Toner Particle]

Regarding the toner particle included in the toner for electrostatic charge image development of the present invention, from the viewpoint of improving transfer efficiency, the average circularity represented by the following Mathematical Formula 1 is preferably 0.920 to 1.000 and more preferably 0.940 to 0.995.

Average Circularity=Perimeter of Circle Obtained from Equivalent Circular Diameter/Perimeter of Projection Image of Particle Mathematical Formula 1

Incidentally, the average circularity can be measured by, for example, an average circularity measurement device "FPIA-2100" (manufactured by Sysmex Corporation).

[Method for Producing Toner for Electrostatic Charge Image Development]

Next, the method for producing the toner for electrostatic charge image development of the present invention will be described. The method for producing the toner for electrostatic charge image development of the present invention is not particularly limited, and examples thereof include well-known methods such as a kneading pulverization method, a suspension polymerization method, an emulsification aggregation method, a dissolution suspension method, a polyester extension method, and a dispersion polymerization method. Among these, from the viewpoint of uniformity of particle diameter, controllability of the shape, and ease of formation of the core-shell structure, an emulsification aggregation method is preferably employed.

The emulsification aggregation method is a method for forming toner particles by mixing a dispersion liquid of fine particles of a resin (hereinafter, also referred to as "resin fine particles") dispersed using a surfactant or a dispersion stabilizer with a dispersion liquid of a toner particle constituent such as fine particles of a colorant, aggregating the particles by addition of an aggregating agent until a desired particle diameter of the toner particle is obtained, performing fusion among the resin fine particles after or at the same time with the aggregation, and controlling the shape.

Here, the resin fine particles can also be composite particles formed of a multilayer of two or more layers which are composed of resins having different compositions.

The resin fine particles can be produced by, for example, an emulsion polymerization method, a mini-emulsion polymerization method, or a phase-transfer emulsification method or by combining several methods. In a case where an internal additive is contained in the resin fine particles, among them, a mini-emulsion polymerization method is preferably used.

In a case where an internal additive is contained in the toner particles, the resin fine particles containing the internal additive may be prepared, or a dispersion liquid of the internal additive fine particles composed of only the internal additive may be prepared separately, and the internal additive fine particles may be aggregated together when the resin fine particles are aggregated.

In addition, toner particles having a core-shell structure can also be obtained by the emulsification aggregation method, and specifically, the toner particles having a core-shell structure can be obtained as follows. First, binder resin fine particles for core particles and a colorant are aggregated (and fused) to prepare core particles. Then, binder resin fine particles for a shell portion are added to a dispersion liquid of the core particles, and the binder resin fine particles for a shell portion are aggregated and fused on the core particle surface to form a shell portion which coats the core particle surface.

The method for producing the toner by the emulsification aggregation method preferably includes a step of preparing a mixed dispersion liquid by putting fine particle dispersion liquid containing the release agent (a) and fine particle dispersion liquid of the crystalline polyester resin (b) into an aqueous medium and a step of forming toner base particles by aggregating the fine particles containing the release agent and the crystalline polyester resin fine particles by raising the temperature of the mixed dispersion liquid. When such a production method is used, a toner in which the crystalline polyester resin having a lamellar structure is present only on the inside of the toner particle can be produced. In order to allow the crystalline polyester resin having a lamellar structure to be further inside the toner particle, it is preferable that the crystalline polyester resin fine particles be added at earlier stage than the aggregation step, that is, at the time of inputting the dispersion liquids or before raising the temperature.

Hereinafter, preferred embodiments will be described in order of steps.

(A) Preparation Step

The preparation step includes a preparation step of a fine particle dispersion liquid of a crystalline polyester resin, a preparation step of a fine particle dispersion liquid of a binder resin other than a crystalline polyester resin (hereinafter, also referred to as an amorphous resin), a preparation step of a colorant dispersion liquid, a preparation step of a fine particle dispersion liquid of a release agent, and the like.

(A-1) Preparation Step of Fine Particle Dispersion Liquid of Crystalline Polyester Resin The crystalline polyester resin fine particle dispersion liquid preparation step is to prepare a dispersion liquid of crystalline polyester resin fine particles by dispersing a crystalline polyester resin constituting toner particles in an aqueous medium in the form of fine particles.

As the method for preparing the crystalline polyester resin fine particle dispersion liquid, for example, a method of performing dispersion treatment in an aqueous medium without using a solvent, a method in which the crystalline polyester resin is dissolved in a solvent such as ethyl acetate to prepare a solution and the solution is emulsified and dispersed in an aqueous medium using a dispersing machine and then subjected to the solvent removal treatment, or the like is exemplified.

The term "aqueous medium" in the present invention indicates a medium containing at least 50% by mass or more of water, and an organic solvent soluble in water can be mentioned as a component other than water. Examples of the organic solvent include methanol, ethanol, isopropanol, butanol, acetone, methyl ethyl ketone, dimethylformamide, methyl cellosolve, and tetrahydrofuran. Among these, it is preferable to use an alcohol-based organic solvent such as methanol, ethanol, isopropanol, or butanol that is an organic solvent which does not dissolve the resin. Preferably, only water is used as the aqueous medium.

The crystalline polyester resin may contain a carboxyl group in some cases. In such a case, ammonia, sodium hydroxide, and the like may be added in order to smoothly perform the emulsification by dissociating the carboxyl group contained in the unit as an ion and stably emulsifying the crystalline polyester resin in the aqueous phase.

Furthermore, a dispersion stabilizer may be dissolved in the aqueous medium or a surfactant or resin fine particles may be added to the aqueous medium for the purpose of improving the dispersion stability of oil droplets.

As the dispersion stabilizer, well-known dispersion stabilizers can be used, and for example, it is preferable to use those which are soluble in an acid or an alkali, such as tricalcium phosphate, or it is preferable to use those which can be degraded by an enzyme from the environmental viewpoint.

As the surfactant, well-known anionic surfactants, cationic surfactants, nonionic surfactants, and amphoteric surfactants can be used.

Further, examples of resin fine particles for improving dispersion stability include polymethyl methacrylate resin fine particles, polystyrene resin fine particles, and polystyrene-acrylonitrile resin fine particles.

Such dispersion treatment can be performed by utilizing mechanical energy. The dispersing machine is not particularly limited, and examples thereof include a homogenizer, a low speed shearing type dispersing machine, a high speed shearing type dispersing machine, a friction type dispersing machine, a high pressure jet type dispersing machine, an ultrasonic dispersing machine, and a high pressure impact type dispersing machine Ultimizer.

The particle diameter of the crystalline polyester resin fine particles (oil droplets) in the crystalline polyester resin fine particle dispersion liquid thus prepared is set to preferably 60 to 1,000 nm and further preferably 80 to 500 nm in terms of the volume-based median size. Incidentally, this volume average particle diameter is measured by a method described in Examples. Incidentally, this volume average particle diameter of the oil droplets can be controlled by, for example, the intensity of the mechanical energy at the time of the emulsifying and dispersing.

In addition, the content of the crystalline polyester resin fine particles in the crystalline polyester resin fine particle dispersion liquid is set to be preferably in the range of 10 to 50% by mass and more preferably in the range of 15 to 40% by mass with respect to 100% by mass of the dispersion liquid. When the content thereof is in such a range, broadening of the particle size distribution can be suppressed and thus the toner characteristics can be improved.

(A-2) Fine Particle Dispersion Liquid Preparation Step of Binder Resin Other than Crystalline Polyester Resin The fine particle dispersion liquid preparation step of the binder resin other than a crystalline polyester resin (amorphous resin) is to prepare a dispersion liquid of amorphous resin fine particles by dispersing an amorphous resin constituting the toner in an aqueous medium in the form of fine particles.

Examples of the method for dispersing an amorphous resin in an aqueous medium include (I) a method in which amorphous resin fine particles are formed from a monomer for obtaining an amorphous resin and an aqueous dispersion liquid of the amorphous resin fine particles is prepared, and (II) a method in which an amorphous resin is dissolved or dispersed in an organic solvent (solvent) to prepare an oil phase liquid, the oil phase liquid is dispersed in an aqueous medium by phase inversion emulsification or the like to form oil droplets in a controlled state so as to have a desired particle size, and the organic solvent (solvent) is then removed.

In the method (I), the following method is preferably used. First, the monomer for obtaining an amorphous resin is added to the aqueous medium together with a polymerization initiator and polymerized to obtain basic particles. Next, a radical-polymerizable monomer for obtaining an amorphous resin and a polymerization initiator are added to the dispersion liquid in which the resin fine particles are dispersed, and the radical-polymerizable monomer is seed-polymerized to the basic particles.

At this time, as the polymerization initiator, a water-soluble polymerization initiator can be used. As the water-soluble polymerization initiator, for example, water-soluble radical polymerization initiators such as potassium persulfate and ammonium persulfate can be preferably used.

Further, a chain-transfer agent that is generally used can be used in the seed-polymerization reaction system for obtaining the amorphous resin fine particles for the purpose of adjusting the molecular weight of the amorphous resin. Examples of the chain-transfer agent, which can be used, include mercaptans such as octylmercaptan, dodecylmercaptan, and t-dodecylmercaptan; mercaptopropionic acids such as n-octyl-3-mercaptopropionate and stearyl-3-mercaptopropionate; and styrene dimers. These can be used alone or in combination of two or more kinds thereof.

In the method (II), as the organic solvent (solvent) used in the preparation of the oil phase liquid, similarly to the above case, from the viewpoint of ease of removal treatment after the formation of oil droplets, those which have a low boiling point and exhibit low solubility in water are preferable, and specific examples thereof include methyl acetate, ethyl acetate, methyl ethyl ketone, isopropyl alcohol, methyl isobutyl ketone, toluene, and xylene. These can be used alone or in combination of two or more kinds thereof.

The used amount of the organic solvent (solvent) (the total used amount in the case of using two or more kinds) is usually 10 to 500 parts by mass, preferably 100 to 450 parts by mass, and further preferably 200 to 400 parts by mass with respect to 100 parts by mass of the amorphous resin.

The used amount of the aqueous medium is preferably 50 to 2,000 parts by mass and more preferably 100 to 1,000 parts by mass with respect to 100 parts by mass of the oil phase liquid. When the used amount of the aqueous medium is set to be in the above ranges, the oil phase liquid can be emulsified and dispersed in the aqueous medium to a desired particle diameter.

In addition, similarly to the above case, a dispersion stabilizer may be dissolved in the aqueous medium, and a surfactant or resin fine particles may be added to the aqueous medium for the purpose of improving the dispersion stability of the oil droplets.

Such emulsification and dispersion of the oil phase liquid can be performed utilizing mechanical energy in the same manner as above. A dispersing machine for performing the emulsification and dispersion is not particularly limited and those described in above (a-1) can be used.

The removal of the organic solvent after the formation of oil droplets can be performed by an operation in which the entire dispersion liquid in a state where the amorphous resin fine particles are dispersed in the aqueous medium is gradually heated to raise the temperature while stirring and then vigorously stirred in a constant temperature region, and the solvent is then removed. Alternatively, the solvent can be removed by using an apparatus such as an evaporator while the pressure is reduced.

The particle diameter of the amorphous resin fine particles (oil droplets) in the amorphous resin fine particle dispersion liquid prepared by the method (I) or (II) is set to preferably 60 to 1,000 nm and further preferably 80 to 500 nm in terms of the volume-based median size. Incidentally, this volume average particle diameter is measured by a method described in Examples. Incidentally, this volume average particle diameter of the oil droplets can be controlled by, for example, the intensity of the mechanical energy at the time of the emulsifying and dispersing.

Further, the content of the amorphous resin fine particle in the amorphous resin fine particle dispersion liquid is set to be preferably in the range of 5 to 50% by mass and more preferably in the range of 10 to 30% by mass. When the content thereof is in such a range, the broadening of the particle size distribution can be suppressed and thus the toner characteristics can be improved.

(A-3) Colorant Dispersion Liquid Preparation Step and Release Agent Fine Particle Dispersion Liquid Preparation Step The colorant dispersion liquid preparation step is to prepare a dispersion liquid of colorant fine particles by dispersing a colorant in an aqueous medium in the form of fine particles. In addition, the release agent fine particle dispersion liquid preparation step is to prepare a dispersion liquid of release agent fine particles by dispersing a release agent in an aqueous medium in the form of fine particles. The release agent fine particle dispersion liquid corresponds to (a) the fine particle dispersion liquid containing the release agent. Incidentally, as the fine particle dispersion liquid containing the release agent, a fine particle dispersion liquid containing a resin in addition to a release agent may be used, and a fine particle dispersion liquid containing only a release agent may be used.

The aqueous medium is the same as that described in the above (A-1), and a surfactant or resin fine particles may be added in the aqueous medium for the purpose of improving dispersion stability.

The colorant/release agent can be dispersed by utilizing mechanical energy. Such a dispersing machine is not particularly limited and those described in above (A-1) can be used.

The content of the colorant in the colorant dispersion liquid is set to be preferably in the range of 10 to 50% by mass and more preferably in the range of 15 to 40% by mass. When the content thereof is set to be in such a range, an effect of securing color reproducibility is achieved. In addition, the content of the release agent fine particles in the release agent fine particle dispersion liquid is set to be preferably in the range of 10 to 50% by mass and more preferably in the range of 15 to 40% by mass. When the content thereof is set to be in such a range, effects of preventing hot offset and securing separability can be achieved.

(B) Aggregation and Fusion Step

The aggregation and fusion step is to obtain toner base particles by aggregating the aforementioned crystalline polyester resin fine particles and, as necessary, amorphous resin fine particles, colorant particles, release agent fine particles, or the like in an aqueous medium and fusing these particles at the same time with aggregation. In this step, it is preferable to perform the step of preparing a mixed dispersion liquid by putting (a) a fine particle dispersion liquid containing the release agent and (b) a fine particle dispersion liquid of the crystalline polyester resin in an aqueous medium and the step of forming toner base particles by aggregating fine particles containing the release agent and the crystalline polyester resin fine particles by raising the temperature of the mixed dispersion liquid.

It is preferable to perform the step of preparing a mixed dispersion liquid by putting (a) a fine particle dispersion liquid containing the release agent and (b) a fine particle dispersion liquid of the crystalline polyester resin in an aqueous medium before the aggregation and fusion. First, at least crystalline polyester resin fine particle dispersion liquid and the release agent fine particle dispersion liquid ((a) the fine particle dispersion liquid containing the release agent), and preferably amorphous resin fine particles and the colorant particles are mixed, and these particles are dispersed in the aqueous medium to thereby prepare the mixed dispersion liquid. The step of preparing a mixed dispersion liquid is preferably performed at 20 to 35° C. Subsequently, the step of forming toner base particles by aggregating fine particles containing the release agent and the crystalline polyester resin fine particles by raising the temperature of the mixed dispersion liquid is performed. Preferably, after an alkali metal salt or a salt containing a group 2 element is added as an aggregating agent in the mixed dispersion liquid, the aggregation is allowed to proceed by heating the resultant dispersion at a temperature equal to or higher than the glass transition temperature of the amorphous resin fine particles, and at the same time, the resin particles are fused to each other. The raising of the temperature is preferably performed by heating up to 60 to 95° C. over 30 to 90 minutes and the heating temperature is more preferably 70 to 85° C.

Then, the temperature after raising the temperature is maintained until the size of the aggregated particles reaches a targeted size. The aggregation is stopped by adding a salt such as saline when the size of the aggregated particles reaches the targeted size. In a case where the toner base particles have a core-shell structure, a dispersion liquid of resin fine particles for shell is further added thereto and the temperature is further raised so that the shell can be aggregated and fused.

In order to allow the crystalline polyester resin having a lamellar structure to be only on the inside of the toner particle, it is important to add the crystalline polyester resin fine particle dispersion liquid to the mixed dispersion liquid before raising the temperature. The reason for this is that, when the temperature of the mixed dispersion liquid is raised in a state the crystalline polyester resin fine particle dispersion liquid is added to the mixed dispersion liquid in advance, the crystalline polyester resin is likely to form a lamellar structure and to be incorporated in the inside of the toner base particles. In addition, in a case where the toner base particles have a core-shell structure, in order to allow the crystalline polyester resin to be further inside the toner particle, it is preferable that the crystalline polyester resin fine particles be present in the aqueous medium at earlier stage of the particle growth, that is, at the stage of the core particle formation without the crystalline polyester resin being added together with the dispersion liquid of resin fine particles for shell at the latter stage of the toner base particle production. That is, it is preferable to add the crystalline polyester resin fine particle dispersion liquid at the initial stage of the core particle forming step (before the temperature of the mixed dispersion liquid is raised).

The aggregating agent used in the present step is not particularly limited, but those selected from the metal salts are preferably used. There are, for example, a salt of a monovalent metal such as a salt of an alkali metal such as sodium, potassium, or lithium, for example, a salt of a divalent metal such as calcium, magnesium, manganese, or copper, a salt of a trivalent metal such as iron or aluminum, and the like. Specific examples of the salt include sodium chloride, potassium chloride, lithium chloride, calcium chloride, magnesium chloride, zinc chloride, copper sulfate, magnesium sulfate, and manganese sulfate. Among these, a salt of a divalent metal is particularly preferable. When a salt of a divalent metal is used, the aggregation can be allowed to proceed with a smaller amount. These aggregating agents can be used alone or in combination of two or more kinds thereof.

In the aggregation step, it is preferable to shorten the standing time to leave to stand after the aggregating agent is added (time until heating is started). That is, it is preferable to start heating of the dispersion liquid for aggregation as soon as possible after the aggregating agent is added and to raise the temperature equal to or higher than the glass transition temperature of the hybrid resin and the amorphous resin. The reason for this is not clear, but this is because it is concerned that the aggregation state of the particles varies depending on the passage of the standing time and thus a problem occurs in that the particle size distribution of the toner particles to be obtained is unstable or the surface properties vary. The standing time is usually set to be within 30 minutes and preferably within 10 minutes. The temperature for adding the aggregating agent is not particularly limited, but is preferably equal to or lower than the glass transition temperature of the hybrid resin as a binder resin and the amorphous resin.

Further, in the aggregation step, it is preferable to rapidly raise the temperature by heating after the aggregating agent is added, and the temperature raising rate is preferably set to 0.8° C./min or more. The upper limit of the temperature raising rate is not particularly limited, but is preferably set to 15° C./min or less from the viewpoint of suppressing the generation of coarse particles caused by rapid progress of fusing. Furthermore, it is important to continue fusion (first aging step) by keeping the temperature of the dispersion liquid for aggregation after the dispersion liquid for aggregation has reached the glass transition temperature or higher for a predetermined time, and preferably until the volume-based median size reaches 4.5 to 7.0 μm. In addition, it is preferable that the average circularity of particles during aging be measured and the first aging step be performed until the average circularity reaches preferably 0.920 to 1.000.

As such, it is possible to effectively perform the growth of the particles (aggregation of the crystalline polyester resin fine particles, the release agent fine particles, and as necessary, the amorphous resin fine particles and colorant particles) and the fusion (disappearance of the interface between particles) and to improve the durability of the toner particles to be finally obtained.

Incidentally, in order to obtain a binder resin having a core-shell structure, an aqueous dispersion liquid of a resin (preferably, the above-described amorphous resin) for forming a shell portion is further added after the first aging step, and the resin for forming a shell portion is aggregated and fused on the surface of the particles (core particles) of the binder resin having a single-layer structure obtained above. Consequently, a binder resin having a core-shell structure is obtained (shell formation step). At this time, subsequently to the shell formation step, the heat treatment of the reaction system may be further performed (second aging step) until the aggregation and fusion of the shell portion to the core particle surface become stronger and the shape of the particles becomes a desired shape. This second aging step may be carried out until the average circularity of the toner particles having a core-shell structure reaches the range of the average circularity described above.

(C) Cooling Step

The cooling step is to subject the dispersion liquid of the toner particles to cooling treatment. The cooling rate in the cooling treatment is not particularly limited, but is preferably 0.2 to 20° C./min. The method for cooling treatment is not particularly limited, and examples thereof include a method in which the dispersion liquid of the toner particles is cooled by introducing a coolant from the outside of the reaction vessel or a method in which the dispersion liquid of the toner particles is cooledbydirectly introducing cold water into the reaction system.

(D) Filtration, Washing, and Drying Steps

In the filtration step, the toner base particles are filtered from the dispersion liquid of the toner particles. As a method for filtration treatment, there are a centrifugal separation method, a reduced pressure filtration method which is carried out using the Nutsche or the like, a filtration method which is carried out using a filter press or the like, and the method for filtration treatment is not particularly limited.

Subsequently, adhered substances such as a surfactant and an aggregating agent are removed from the filtered toner base particles (cake-like aggregate material). The washing step is to perform washing treatment with water until the electric conductivity of the filtrate reaches, for example, a level of 5 to 10 μS/cm.

In the drying step, the toner base particles subjected to the washing treatment are subjected to drying treatment. Examples of a dryer used in the drying step include a well-known dryer such as a spray dryer, a vacuum freeze dryer, or a vacuum dryer, and it is also possible to use a shelf-type static dryer, a shelf-type mobile drier, a fluidized bed drier, a rotary dryer, a stirring-type dryer, and the like. The water content contained in the dried toner base particles is preferably 5% by mass or less and more preferably 2% by mass or less.

Further, in a case where the toner base particles subjected to the drying treatment are aggregated with each other by a weak inter-particle attractive force, crushing treatment may be performed. It is possible to use a mechanical crushing device such as a jet mill, a Henschel mixer, a coffee mill, or a food processor as a crushing device.

In this way as described above, the toner base particles are formed.

(E) External Additive Treatment Step

This step is to produce toner particles (a toner) by adding an external additive to the surface of the toner base particles subjected to the drying treatment and mixing them as necessary. With the addition of the external additive, the flowability and the chargeability of the toner are improved and the improvement in cleaning ability, and the like are realized.

<Developer>

The toner of the present invention is considered to be used, for example, as a one-component magnetic toner by containing a magnetic material, a two-component developer by mixing with a so-called carrier, and a non-magnetic toner singly, and can be suitably used in any cases.

As the carrier constituting the two-component developer, it is possible to use magnetic particles composed of materials known in the related art such as a metal including iron, ferrite, or magnetite, and an alloy of these metals with a metal such as aluminum or lead, and particularly, ferrite particles are preferably used.

As the carrier, those which have a volume average particle diameter of 15 to 100 μm are preferable and those which have a volume average particle diameter of 25 to 60 μm are more preferable.

As the carrier, it is preferable to use those which are further coated with a resin or a so-called resin dispersion type carrier in which magnetic particles are dispersed in a resin. The composition of the resin for coating is not particularly limited, but for example, an olefin resin, a cyclohexyl methacrylate-methyl methacrylate copolymer, a styrene resin, a styrene-acrylic resin, a silicone resin, an ester resin, or a fluorine resin is used. In addition, the resin for constituting the resin dispersion type carrier is not particularly limited, and well-known ones can be used. For example, an acrylic resin, a styrene-acrylic resin, a polyester resin, a fluorine resin, a phenol resin, or the like can be used.

EXAMPLES

Hereinafter, embodiments of the present invention will be described in detail by means of Examples, but the present invention is not limited thereto.

Example 1

Synthesis of Hybrid Crystalline Polyester Resin [a]

A raw material monomer of an addition polymerization resin, a dually reactive monomer, and a radical-polymerization initiator to be described below were put into a dropping funnel.

| | |
|---|---|
| Styrene | 35 parts by mass |
| Butyl acrylate | 9 parts by mass |
| Acrylic acid | 4 parts by mass |
| Polymerization initiator (di-t-butyl peroxide) | 7 parts by mass |

Further, the following raw material monomer of the polycondensation resin was put in a four-neck flask equipped with a nitrogen inlet tube, a dehydration tube, a stirrer, and a thermocouple and dissolved by heating at 170° C.

| | |
|---|---|
| Sebacic acid | 278 parts by mass |
| Dodecanediol | 280 parts by mass |

Subsequently, the raw material monomer of the addition polymerization resin was added dropwise thereto over 90 minutes under stirring, the resultant was aged for 60 minutes, and the unreacted addition polymerization monomer was then removed therefrom under reduced pressure (8 kPa). Thereafter, 0.8 part by mass of $Ti(OBu)_4$ as an esterification catalyst was put therein, the temperature was raised up to 235° C., and the reaction was carried out for 5 hours under normal pressure (101.3 kPa) and further for 1 hour under reduced pressure (8 kPa). Next, the resultant was cooled to 200° C. and then allowed to react for 1 hour under reduced pressure (20 kPa), thereby obtaining a hybrid crystalline polyester resin [a]. Regarding the obtained hybrid crystalline polyester resin [a], the number average molecular weight (Mn) was 4,000, the melting point was 81° C., and the acid value was 23 mgKOH/g.

[Preparation of Aqueous Dispersion Liquid of Hybrid Crystalline Polyester Resin Fine Particles [a]]

30 parts by mass of the hybrid crystalline polyester resin [a] was melted and transferred to an emulsifying disperser "CAVITRON CD1010" (manufactured by Eurotec, Ltd.) at a transfer rate of 100 parts by mass per minute as it was in a molten state. Further, at the same time as this transferring of the hybrid crystalline polyester resin [a] in a molten state, diluted ammonia water of the concentration of 0.37% by mass obtained by diluting 70 parts by mass of reagent ammonia water with ion-exchanged water in an aqueous solvent tank was transferred to the emulsifying disperser at a transfer rate of 0.1 liter per minute while being heated at 100° C. using a heat exchanger. Then, this emulsifying disperser was operated under the conditions including a rotational speed of a rotator of 60 Hz and a pressure of 5 $kg/cm^2$, thereby preparing an aqueous dispersion liquid of hybrid crystalline polyester resin fine particles [a] having a volume-based median size of 200 nm and a solid content of 30 parts by mass (10% by mass in the dispersion liquid).

[Preparation of Aqueous Dispersion Liquid of Amorphous Resin Fine Particles [X]]

(First Polymerization)

Into a 5 L reaction vessel equipped with a stirring device, a temperature sensor, a condenser tube, and a nitrogen gas-introducing device, 8 g of sodium dodecyl sulfate and 3 L of ion-exchanged water were charged while stirring at a stirring speed of 230 rpm in a nitrogen stream, and then the internal temperature was raised to 80° C. After the temperature was raised, a solution obtained by dissolving 10 g of potassium persulfate in 200 g of ion-exchanged water was added thereto, the liquid temperature was raised to 80° C. again, and the following monomer mixed liquid was added dropwise thereto over 1 hour. Thereafter, heating and stirring was carried out at 80° C. for 2 hours to perform polymerization, thereby preparing a dispersion liquid of resin fine particles [x1].

| | |
|---|---|
| Styrene | 480 g |
| n-Butyl acrylate | 250 g |
| Methacrylic acid | 68.0 g |

(Second Polymerization)

Into a 5 L reaction vessel equipped with a stirring device, a temperature sensor, a condenser tube, and a nitrogen gas-introducing device, a solution obtained by dissolving 8 g of sodium polyoxyethylene(2) dodecyl ether sulfate in 3 L of ion-exchanged water was charged and heated to 98° C. Thereafter, a solution obtained by dissolving 242 g of the dispersion liquid of resin fine particles [x1], the following monomer, and a release agent at 90° C. was added thereto.

| | |
|---|---|
| Styrene (St) | 269 g |
| 2-Ethylhexyl acrylate (2EHA) | 88 g |
| Methacrylic acid (MAA) | 36 g |
| n-Octyl-3-mercaptopropionate | 6.4 g |
| Release agent: behenyl behenate (Ester 1, melting point: 73° C.) | 141 g |

The mixed liquid was mixed and dispersed for 1 hour using a mechanical stirrer "CLEARMIX" (manufactured by M Technique Co., Ltd.) having a circulation path, thereby preparing a dispersion liquid containing emulsified particles (oil droplets). Subsequently, an initiator solution obtained by dissolving 5 g of potassium persulfate in 200 ml of ion-exchanged water was added to this dispersion liquid, and the system was heated and stirred at 84° C. over 1 hour to perform polymerization, thereby preparing a dispersion liquid of resin fine particles [x2].

(Third Polymerization)

Furthermore, 400 ml of ion-exchanged water was added to the dispersion liquid of resin fine particles [x2] and then mixed well. Thereafter, a solution obtained by dissolving 6 g of potassium persulfate in 400 ml of ion-exchanged water was added thereto, and the following monomer mixed liquid was added dropwise thereto over 1 hour under a temperature condition of 82° C.

| | |
|---|---|
| Styrene (St) | 430 g |
| n-Butyl acrylate | 155 g |
| Methacrylic acid (MAA) | 50 g |
| n-Octyl-3-mercaptopropionate | 10 g |

After the dropwise addition was ended, the mixture was heated and stirred over 2 hours to perform polymerization, and the resultant was then cooled at 28° C., thereby preparing an aqueous dispersion liquid of amorphous resin fine particles [X] composed of a vinyl resin.

Regarding the obtained aqueous dispersion liquid of amorphous resin fine particles [X], the volume-based median size of the amorphous resin fine particles was 220 nm, the glass transition temperature (Tg) was 40° C., and the weight average molecular weight (Mw) was 32,000.

[Preparation of Aqueous Dispersion Liquid of Resin Fine Particles for Shell [S]]

(1) Synthesis of Polyester Resin

A raw material monomer of an addition polymerization resin, a dually reactive monomer, and a radical polymerization initiator to be described below were put into a dropping funnel.

| | |
|---|---|
| Styrene | 80 parts by mass |
| Butyl acrylate | 20 parts by mass |
| Acrylic acid | 10 parts by mass |
| Polymerization initiator (di-t-butyl peroxide) | 16 parts by mass |

Further, a raw material monomer of a polycondensation resin to be described below was put into a four-neck flask equipped with a nitrogen inlet tube, a dehydration tube, a stirrer, and a thermocouple, and dissolved by heating to 170° C.

| | |
|---|---|
| Adduct of bisphenol A with 2 mole of propylene oxide | 285.7 parts by mass |
| Terephthalic acid | 66.9 parts by mass |
| Fumaric acid | 47.4 parts by mass |

Subsequently, the raw material monomer of the addition polymerization resin was added dropwise thereto over 90 minutes under stirring, the resultant was aged for 60 minutes, and the unreacted addition polymerization monomer was then removed therefrom under reduced pressure (8 kPa). Thereafter, 0.4 part by mass of $Ti(OBu)_4$ as an esterification catalyst was put therein, the temperature was raised up to 235° C., and the reaction was carried out for 5 hours under normal pressure (101.3 kPa) and further for 1 hour under reduced pressure (8 kPa). Next, the resultant was cooled to 200° C. and then the reaction was carried out under reduced pressure (20 kPa) until a desired softening point was reached. Subsequently, solvent removal was performed to thereby obtain a resin for shell [s].

(3) Preparation of Aqueous Dispersion Liquid of Resin Fine Particles for Shell

In 400 parts by mass of ethyl acetate (manufactured by KANTO CHEMICAL CO., INC.), 100 parts by mass of the resin for shell [s] thus obtained was dissolved, the solution was mixed with 638 parts by mass of sodium lauryl sulfate solution having a concentration of 0.26% by mass which was prepared in advance, and the mixture was ultrasonically dispersed for 30 minutes at V-LEVEL of 300 μA with an ultrasonic homogenizer "US-150T" (manufactured by NISSEI Corporation) while stirring. Thereafter, ethyl acetate was completely removed from the resultant in a state where the dispersion liquid was warmed at 40° C. with a diaphragm vacuum pump "V-700" (manufactured by BUCHI Labortechnik AG) while stirring for 3 hours under reduced pressure, thereby preparing an aqueous dispersion liquid of resin fine particles for shell [S] having an average particle diameter (volume-based median size) of 160 nm and a solid content of 13.5% by mass.

[Preparation of Aqueous Dispersion Liquid of Colorant Fine Particles [Cy]]

To 1600 parts by mass of ion-exchanged water, 90 parts by mass of sodium dodecyl sulfate was added. To this solution, 420 parts by mass of copper phthalocyanine (C. I. Pigment Blue 15:3) was gradually added while stirring this solution, the mixture was then subjected to dispersion treatment with a stirring device "CLEARMIX" (manufactured by M Technique Co., Ltd.), thereby preparing an aqueous dispersion liquid of colorant fine particles [Cy].

Regarding the obtained aqueous dispersion liquid of colorant fine particles [Cy], the average particle diameter (volume-based median size) of colorant fine particles was 110 nm.

[Production 1 of Cyan Toner]

Into a reaction vessel equipped with a stirring device, a temperature sensor, and a condenser tube, 195 parts by mass (in terms of solid content) of the aqueous dispersion liquid of amorphous resin fine particles [X], 30 parts by mass (in terms of solid content) of the aqueous dispersion liquid of hybrid crystalline polyester resin fine particles [a], and 2,000 parts by mass of ion-exchanged water were put, and 5 mole/liter of an aqueous solution of sodium hydroxide was added thereto so that the pH was adjusted to 10.

Thereafter, 40 parts by mass (in terms of solid content) of the aqueous dispersion liquid of colorant fine particles [Cy] was put therein, an aqueous solution obtained by dissolving 60 parts by mass of magnesium chloride in 60 parts by mass of ion-exchanged water was then added thereto over minutes at 25° C. under stirring. Thereafter, the temperature thereof was then started to be raised, this system was heated up to 82° C. over 60 minutes, and the particle growth reaction was continued while the temperature was held at 82° C.

In this state, the particle diameter of associated particles was measured with "COULTER MULTISIZER 3" (manufactured by Beckman Coulter, Inc.), and at the time point when the volume-based median size became 6.0 μm, the resultant was cooled to 79° C. Then, 75 parts by mass (in terms of solid content) of the aqueous dispersion liquid [S] of resin fine particles for shell was put thereto over 10 minutes, and at the time point when the supernatant of the reaction liquid became transparent, the resultant was cooled to 73° C. Then, the particle growth was stopped by adding an aqueous solution obtained by dissolving 190 parts by mass of sodium chloride in 760 parts by mass of ion-exchanged water. The fusion of particles was allowed to proceed by heating and stirring.

The resultant was cooled to 30° C. at a cooling rate of 2.5° C./min at a time point when the average circularity (HPF detection number: 4,000) measured by using a toner particle average circularity measurement device "FPIA-2100" (manufactured by Sysmex Corporation) became 0.945.

Subsequently, an operation of performing solid-liquid separation, dispersing a dehydrated toner cake in ion-exchanged water again, and performing solid-liquid separation was repeated three times and then washing was carried out. Thereafter, drying was carried out at 40° C. for 24 hours to thereby obtain cyan toner particles [1X].

To 100 parts by mass of the toner particles [1X] thus obtained, 0.6 part by mass of hydrophobic silica (number average primary particle diameter=12 nm, hydrophobicity=68) and 1.0 part by mass of hydrophobic titanium oxide (number average primary particle diameter=20 nm, hydrophobicity=63) were added, the mixture was mixed for 20 minutes at 32° C. and a peripheral speed of rotor blades of 35 mm/sec with a "Henschel mixer" (manufactured by MITSUI MIIKE MACHINERY Co., Ltd.) and then subjected to the external additive treatment to remove coarse particles using a sieve having a mesh opening of 45 μm, thereby producing a toner [1].

A ferrite carrier which was coated with a silicone resin and had a volume average particle diameter of 60 μm was added to and mixed with the toner [1] such that the toner concentration became 6% by mass, thereby producing a developer [1].

Examples 2 to 10

A toner and a developer were produced according to the production method of Example 1 in the same manner in Example 1, except that the types of release agents were changed from behenyl behenate (Ester 1) to the types presented in the following Table 1, respectively. The release agents used are specifically as follows:

Ester 1: behenyl behenate

Ester 2: pentaerythritol tetrabehenic acid ester

Ester 3: pentaerythritol tetrastearic acid ester

Hydrocarbon 1: Fischer-Tropsch wax (melting point: 76° C.)

Hydrocarbon 2: Fischer-Tropsch wax (melting point: 90° C.)

Hydrocarbon 3: microcrystalline wax

Example 11

A aqueous dispersion liquid of hybrid crystalline polyester resin fine particles [a], an aqueous dispersion liquid of amorphous resin fine particles [X], and an aqueous dispersion liquid of colorant fine particles [Cy] were prepared in the same manner as in Example 1.

[Production 11 of Cyan Toner]

Into a reaction vessel equipped with a stirring device, a temperature sensor, and a condenser tube, 195 parts by mass (in terms of solid content) of the aqueous dispersion liquid of amorphous resin fine particles [X], 30 parts by mass (in terms of solid content) of the aqueous dispersion liquid of hybrid crystalline polyester resin fine particles [a], and 2,000 parts by mass of ion-exchanged water were put, and 5 mole/liter of an aqueous solution of sodium hydroxide was added thereto so that the pH was adjusted to 10.

Thereafter, 40 parts by mass (in terms of solid content) of the aqueous dispersion liquid [Cy] of colorant fine particles was put therein, an aqueous solution obtained by dissolving 60 parts by mass of magnesium chloride in 60 parts by mass of ion-exchanged water was then added thereto over minutes at 25° C. under stirring. Thereafter, the temperature thereof was then started to be raised, this system was heated up to 82° C. over 60 minutes, and the particle growth reaction was continued while the temperature was held at 82° C. In this state, the particle diameter of associated particles was measured with "COULTER MULTISIZER 3" (manufactured by Beckman Coulter, Inc.), and at the time point when the volume-based median size became 6.0 μm, the resultant was cooled to 73° C. Then, the particle growth was stopped by adding an aqueous solution obtained by dissolving 190 parts by mass of sodium chloride in 760 parts by mass of ion-exchanged water. The fusion of particles was allowed to proceed by heating and stirring.

The resultant was cooled to 30° C. at a cooling rate of 2.5° C./min at a time point when the average circularity (HPF detection number: 4,000) measured by using a toner particle average circularity measurement device "FPIA-2100" (manufactured by Sysmex Corporation) became 0.945.

Subsequently, an operation of performing solid-liquid separation, dispersing a dehydrated toner cake in ion-exchanged water again, and performing solid-liquid separation was repeated three times and then washing was carried out. Thereafter, drying was carried out at 40° C. for 24 hours to thereby obtain cyan toner particles [11X].

A toner was produced in the same manner as in Example 1, except that the cyan toner particles [11X] described above were used, and then a developer was produced.

Examples 12 to 13

A toner and a developer were produced according to the production method of Example 11 in the same manner in Example 11, except that the types of release agents were changed from behenyl behenate (Ester 1) to the types presented in Table 1, respectively.

Comparative Example 1

A toner and a developer were produced in the same manner as in Example 1, except that, in the production method of Example 1, the release agent was changed to the release agent presented in Table 1 and the addition timing of the crystalline polyester resin fine particles was changed to the addition timing at the time point when the volume-based median size of the associated particles grew to 6 μm before the temperature was raised.

Comparative Examples 2 to 3

A toner and a developer were produced according to the production method of Example 11 in the same manner in Example 11, except that the types of release agents were changed to the types presented in Table 1 and the addition timing of the crystalline polyester resin fine particles was changed to the addition timing at the time point when the volume-based median size of the associated particles grew to 6 μm before the temperature was raised.

<Evaluation Method>

(1) Lamellar Structure (Method for Observing Cross-Sections of Toner Particles)

The cross-sections of the toner particles were observed by using the following device and conditions.

Device: transmission electron microscope "JEM-2000FX" (manufactured by JEOL Ltd.)

Sample: slices of toner particles stained with ruthenium tetroxide ($RuO_4$) (slice thickness: 60 to 100 nm)

Acceleration voltage: 80 kV

Magnification: 50,000 folds, clear image (Method for Preparing Slices of Toner Particles)

After 10 mg of toner particles were exposed once or twice under the condition using a vacuum electron staining device VSC1R1 (manufactured by Filgen, Inc.), the toner particles were dispersed in a photocurable resin "D-800" (manufactured by JEOL Ltd.) and subjected to UV light curing, thereby forming a block. Subsequently, ultrathin flaky samples having a thickness of 60 to 100 nm were cut out from the block by using a microtome equipped with diamond teeth.

(Ruthenium Tetroxide Staining Condition)

Staining was performed by using a vacuum electron stain device VSC1R1 (manufactured by Filgen, Inc.). A sublimation chamber containing ruthenium tetroxide was installed on the staining device main body according to the device procedure. The prepared ultrathin slices were introduced into a staining chamber and then stained with the staining condition of ruthenium tetroxide under the conditions including room temperature (24 to 25° C.), a concentration of 3 (300 Pa), and a time of 10 minutes.

(Observation of Lamellar Structure)

After staining, the toner particle was observed within 24 hours by a transmission electron microscope "JEM-2000FX" (manufactured by JEOL Ltd.). As the measurement number of the lamellar structures, the aforementioned operation was performed on 100 toner particles. The evaluation results on the ratio of toner particles in which the lamellar structure was observed only in the inside of the toner particle to the total observed toner particles were shown in the section "Inside of toner particle" of Table 1 described below.

In addition, in the section "Region," a case where toner particles in which the lamellar structure was not observed in range extending from the surface of the toner particle to a depth less than 0.1 times the particle diameter of the toner particle were 80% or more of the total observed toner particles was rated as "○" and a case where the relevant toners were less than 80% of the total observed toner particles was rated as "x".

(Method for Measuring Domain Diameter of Lamellar Structure of Crystalline Polyester Resin)

The domain diameter of the lamellar structure of the crystalline polyester resin in the toner particles was calculated as the horizontal maximum cord (CORD H) of the lamellar structure of the crystalline polyester resin in the cross-section of the toner particle.

The method for preparing the cross-section of the toner particle followed the above "Method for Preparing Slices of Toner Particles." Subsequently, ultrathin flaky samples having a thickness of 60 to 100 nm were cut out from the block by using a microtome equipped with diamond teeth. The test pieces were stained with ruthenium tetroxide using a vacuum electron staining device VSC1R1 (manufactured by Filgen, Inc.). According to the operation procedure, a sublimation chamber containing ruthenium tetroxide was installed on the staining device main body, and the prepared ultrathin slices were introduced into a staining chamber and then stained with the staining condition of ruthenium tetroxide under the conditions including room temperature (24 to 25° C.), a concentration of 3 (300 Pa), and a time of 10 minutes.

After staining, the cross-section of the toner particle was photographed within 24 hours by a transmission electron microscope "JEM-2000FX" (manufactured by JEOL Ltd.) at an acceleration voltage of 80 kV and a magnification of 50,000 folds, the photographed image was read by a scanner, and then the horizontal maximum cord "CODE H" of the lamellar structure of the crystalline polyester resin dispersed in the toner binder resin was measured by using an image processing analyzer LUZEX AP (manufactured by NIRECO CORPORATION).

For the measurement number of the lamellar structures, the aforementioned operation was performed on 100 toner particles. Regarding the domain diameter, the domain diameter of each of toner particles in which the lamellar structure was observed among the measured 100 toner particles was measured and the average value thereof was calculated.

(Ratio of Cross-Sectional Area of Lamellar Structure to Cross-Sectional Area of Toner Particle)

The cross-section of the toner particle was photographed by the same method and device as those in the method of measuring the domain diameter, and the cross-sectional areas of the toner particle and the lamellar structure portion were obtained by using "AREA" of an image processing analyzer LUZEX AP (manufactured by NIRECO CORPORATION). Based on the results thereof, the ratio of the cross-sectional area of the lamellar structure to the cross-sectional area of the toner particle was calculated.

(2) Low Temperature Fixability

A commercially-available full color multi-functional machine "bizhub (trademark) C754" (manufactured by Konica Minolta, Inc.) which was modified such that the surface temperatures of an upper fixing belt and a lower fixing roller were changeable was used as an image forming apparatus. As a developer, each developer of Examples 1 to 13 and Comparative Examples 1 to 3 was mounted thereon, a test of printing a solid image with a toner adhesion amount of 11.3 g/m$^2$ on a recording material "mondi Color Copy A4 90 g/m$^2$ (manufactured by Mondi)" under the environment of normal temperature and normal humidity (20° C., 50% RH) at a nip width of 11.2 mm, a fixing time of 34 msec, a fixing pressure of 133 kPa, and a fixing temperature of 100 to 200° C., was repeated while the fixing temperature was changed by 5° C. until the cold offset occurred. The lowest surface temperature of the upper fixing belt in which the cold offset did not occur was examined, and the low temperature fixability was evaluated while this temperature was considered as the lower limit of the fixing temperature. In each test, the fixing temperature indicates the surface temperature of the upper fixing belt. The results thereof are presented in the following Table 2. As the lower limit of the fixing temperature decreases, more excellent low temperature fixability is exhibited.

(3) Fixing Separation Property

The modified machine of "bizhub (trademark) C754" (manufactured by Konica Minolta, Inc.) was used, a test of printing whole solid image with a toner adhesion amount of 4.0 g/m$^2$ and an end margin of 8 mm on a recording material "KINFUJI 85 g/m$^2$ machine direction" (manufactured by Oji Paper Co., Ltd.) which had been conditioned by being left to stand overnight under the normal temperature and normal humidity environment (temperature: 25° C., relative humidity: 50% RH), at a nip width of 11.2 mm, a fixing time of 34 msec, a fixing pressure of 133 kPa, and a fixing temperature at which the upper belt became 160° C. in the normal temperature and normal humidity environment (temperature: 25° C., humidity: 50% RH), was repeated while the end margin was changed to be reduced by 1 mm, that is, 7 mm, 6 mm, . . . , until a paper jam occurred. The minimum end margin in which the paper jam did not occur was examined, and the fixing separation property was evaluated based on this end margin. The results thereof are presented in Table 2. As the minimum end margin decreases, the fixing separation property is further improved. In the present invention, the evaluation criteria of "○" or higher are considered as passing.

—Evaluation Criteria—

⊙ End margin is 2 mm or less.

○ End margin is 3 mm or less.

Δ End margin is 4 mm or less.

× End margin is more than 4 mm.

(4) Storage Stability (50% Aggregation Temperature)

Into a 10 ml glass bottle with an inner diameter of 21 mm, 0.5 g of the toner was taken, the lid was put thereon, the bottle was shaken 600 times at room temperature using a shaking apparatus "TAPDENSER KYT-2000" (manufactured by SEISHIN ENTERPRISE Co., Ltd.) and left to stand for 2 hours under the environment of a temperature of 55° C. and a relative humidity of 35% RH in a state where the lid was taken off. Subsequently, the toner was placed on the sieve having 48 meshes (mesh opening: 350 μm) while paying attention so as not to crush the toner aggregate, set in "Powder Tester" (manufactured by HOSOKAWA MICRON CORPORATION), and immobilized with the pressing bar and the knob nut, the vibration intensity was adjusted so as to have a sending width of 1 mm, vibration was applied to the toner for 10 seconds, the ratio (% by mass) of the toner amount remaining on the sieve was measured, and the toner aggregation ratio was calculated by the following equation. This test was repeated while the test temperature was raised by 0.1° C. without changing the relative humidity of 35% RH until the toner aggregation ratio exceeded 50% by mass. The maximum test temperature at which the toner aggregation ratio did not exceed 50% by mass (limit temperature of heat-resistant storage) was considered as an index of the heat-resistant storage property.

$$\text{Toner aggregation ratio (\% by mass)} = \text{Mass of toner remaining on sieve (g)}/0.5\text{ (g)} \times 100$$

In the present invention, a case where the limit temperature of heat-resistant storage is 56.5° C. or higher is considered as passing.

(5) Toner Flowability

A bulk density was obtained as an index of flowability by means of Kawakita system bulk density meter (IH2000 type). Specifically, the method for measuring the bulk density was as follows.

The toner to be measured was left to stand overnight under the environment of normal temperature and normal humidity (20° C., 50% RH), 20 g of sample was placed on a sieve having 48 meshes and dropped at a vibration intensity of 6 for 30 seconds, and then the vibration was stopped and the sample was left to stand still for 3 minutes. Thereafter, the level bulk density (static bulk density) (toner weight/volume (20 cm$^3$)) was obtained.

The case of a static bulk density of 45 g/100 ml or more was evaluated to have excellent toner flowability and rated as "⊙," the case of a static bulk density of 40 g/100 ml or more and less than 45 g/100 ml was evaluated to be good and rated as "○," the case of a static bulk density of 35 g/100 ml or more and less than 40 g/ml was evaluated to be practicable and rated as "Δ," and the case of a static bulk density of less than 35 g/100 ml was evaluated to be poor and rated as "×."

(6) Fogging

An image forming apparatus "bizhub PRO (trademark) C6500" (printing speed of about 65 sheet/min) (manufactured by Konica Minolta Business Solutions Japan Co., Ltd.) equipped with a development device for a two-component developer was used, and the "developers of Examples (1) to (13)" and the "developers of Comparative Examples (1) to (3)" each were mounted thereon. 300,000 sheets were printed using A4-size high quality paper (65 g/m$^2$) under the environment of normal temperature and normal humidity (25° C., relative humidity: 50% RH), non-image portions at the time of starting printing and after completing printing of 300,000 sheets were observed using a microscope "VHX-2000" (manufactured by KEYENCE CORPORATION) at a magnification of 100 folds, and the fogging was evaluated based on the average value of the toner occupied area ratios in five fields of view. The occupied area ratio was calculated based on software in such a manner that the photographed fields of view were read and binarized by using a commercially available image processing software. The calculation formula is "Occupied area ratio (%)=(occupied area of toner)/(area of field of view)." A case where this occupied area ratio was 0% or more and less than 1% was considered as "passing."

—Evaluation Criteria—

⊙ 0% or more and less than 0.5%

○ 0.5% or more and less than 1%

× 1% or more

3. The reason for achieving these results is considered that the crystalline polyester resin has a lamellar structure and the lamellar structure is present only on the inside of the toner particle.

TABLE 1

| | Release agent | | | Lamellar structure | | | | |
|---|---|---|---|---|---|---|---|---|
| | Type | Melting point (° C.) | Acid value | Inside of toner particle (%) | Region | Domain average diameter (μm) | Cross-sectional area ratio (%) | Addition timing of crystalline polyester resin |
| Examples | | | | | | | | |
| 1 | Ester 1 | 72 | 0.1 | 90 | ○ | 0.6 | 15 | Before raising temperature |
| 2 | Ester 2 | 85 | 0.5 | 90 | ○ | 0.8 | 10 | Before raising temperature |
| 3 | Ester 3 | 75 | 1 | 90 | ○ | 1 | 5 | Before raising temperature |
| 4 | Hydrocarbon 1 | 78 | 0.1 | 90 | ○ | 0.9 | 10 | Before raising temperature |
| 5 | Hydrocarbon 2 | 90 | 0.1 | 90 | ○ | 1.7 | 7 | Before raising temperature |
| 6 | Hydrocarbon 3 | 83 | 0.1 | 90 | ○ | 0.4 | 12 | Before raising temperature |
| 7 | Ester 1/Hydrocarbon 1 = 1/1 | 73 | 0.1 | 90 | ○ | 0.9 | 13 | Before raising temperature |
| 8 | Ester 1/Hydrocarbon 2 = 1/1 | 85 | 0.1 | 90 | ○ | 1.3 | 11 | Before raising temperature |
| 9 | Ester 1/Hydrocarbon 3 = 1/1 | 75 | 0.1 | 90 | ○ | 0.5 | 13 | Before raising temperature |
| 10 | Ester 3/Hydrocarbon 1 = 1/1 | 80 | 1 | 90 | ○ | 1.5 | 13 | Before raising temperature |
| 11 | Ester 1 | 72 | 0.1 | 85 | ○ | 0.7 | 15 | Before raising temperature |
| 12 | Hydrocarbon 1 | 83 | 0.1 | 85 | ○ | 1.1 | 10 | Before raising temperature |
| 13 | Ester 1/Hydrocarbon 1 = 1/1 | 73 | 0.1 | 85 | ○ | 0.9 | 12 | Before raising temperature |
| Comparative Examples | | | | | | | | |
| 1 | Ester 1 | 73 | 0.1 | 50 | X | <0.1 | 0.5 | Particle diameter 6 μm |
| 2 | Hydrocarbon 1 | 78 | 0.1 | 50 | X | 3 | 0.1 | Particle diameter 6 μm |
| 3 | Ester 1 | 73 | 0.1 | 50 | X | 4 | 0.7 | Particle diameter 6 μm |

TABLE 2

| | Low temperature fixability (fixing start temperature ° C.) | Storage stability (50% aggregation temperature ° C.) | Fixing separation property | Flow-ability | Fog-ging |
|---|---|---|---|---|---|
| Example 1 | 150 | 60 | ⊙ | ⊙ | ⊙ |
| Example 2 | 150 | 60 | ⊙ | ⊙ | ⊙ |
| Example 3 | 155 | 58 | ⊙ | ⊙ | ⊙ |
| Example 4 | 155 | 62 | ⊙ | ⊙ | ⊙ |
| Example 5 | 155 | 62 | ⊙ | ⊙ | ⊙ |
| Example 6 | 155 | 62 | ⊙ | ⊙ | ⊙ |
| Example 7 | 155 | 62 | ⊙ | ⊙ | ⊙ |
| Example 8 | 155 | 62 | ⊙ | ⊙ | ⊙ |
| Example 9 | 155 | 62 | ⊙ | ⊙ | ⊙ |
| Example 10 | 155 | 60 | ⊙ | ⊙ | ⊙ |
| Example 11 | 150 | 58 | ⊙ | ○ | ○ |
| Example 12 | 150 | 58 | ⊙ | ○ | ○ |
| Example 13 | 150 | 58 | ⊙ | ○ | ○ |
| Comparative Example 1 | 165 | 52 | Δ | X | X |
| Comparative Example 2 | 155 | 52 | X | X | X |
| Comparative Example 3 | 155 | 50 | X | X | X |

As clearly seen from the above Table 2, the toners of Examples 1 to 13 exhibited substantially equal or more excellent results on the low temperature fixability, the heat-resistant storage property (storage stability), the fixing separation property, the flowability, and the chargeability (fogging evaluation) as compared to Comparative Examples 1 to

The invention claimed is:

1. A toner for electrostatic charge image development comprising toner particles which comprise a binder resin including a crystalline polyester resin and a release agent, wherein the crystalline polyester resin has a lamellar structure and the lamellar structure is present only on the inside of the toner particle when a cross-section of the toner particle subjected to ruthenium staining is observed with a transmission electron microscope.

2. The toner for electrostatic charge image development according to claim 1, wherein the content of the toner particles including the lamellar structure of the crystalline polyester resin only on the inside of the toner particle is 90% or more of the total toner particles.

3. The toner for electrostatic charge image development according to claim 1, wherein a domain diameter of the lamellar structure is 0.1 to 2 μm.

4. The toner for electrostatic charge image development according to claim 1, wherein the content of the toner particles having a domain diameter of the lamellar structure in the range of 0.1 to 2 μm are 80% or more of the total toner particles.

5. The toner for electrostatic charge image development according to claim 1, wherein the ratio of the cross-sectional area of the lamellar structure to the cross-sectional area of the toner particle in the cross-section of the ruthenium-stained toner particle is 1 to 20%.

6. The toner for electrostatic charge image development according to claim 1, wherein the ratio of the cross-sectional area of the lamellar structure to the cross-sectional area of the toner particle in the cross-section of the ruthenium-stained toner particle is 5 to 15%.

7. The toner for electrostatic charge image development according to claim 1, the added amount of the crystalline polyester resin is 1% by mass or more and less than 50% by mass of the total binder resin.

8. The toner for electrostatic charge image development according to claim 1, wherein the crystalline polyester resin is a hybrid crystalline polyester resin formed by chemically bonding a crystalline polyester resin unit and an amorphous resin unit other than a polyester resin.

9. The toner for electrostatic charge image development according to claim 8, wherein the content ratio of the hybrid crystalline polyester resin to the total binder resin is 1% by mass or more and less than 50% by mass.

10. The toner for electrostatic charge image development according to claim 8, wherein the melting point of the hybrid crystalline polyester resin is 55° C. or higher and 90° C. or lower.

11. The toner for electrostatic charge image development according to claim 8, wherein the content of the crystalline polyester resin unit is 80% by mass or more and less than 98% by mass with respect to the total amount of the hybrid crystalline polyester resin.

12. The toner for electrostatic charge image development according to claim 1, wherein the release agent comprises an ester wax or a hydrocarbon wax.

13. The toner for electrostatic charge image development according to claim 1, wherein a melting point of the release agent is 60 to 100° C.

14. The toner for electrostatic charge image development according to claim 1, wherein an acid value of the release agent is 0.1 to 10 mgKOH/g.

15. A method for producing the toner for electrostatic charge image development according to claim 1, the method comprising:

a step of preparing a mixed dispersion liquid by putting (a) a fine particle dispersion liquid comprising the release agent and (b) a fine particle dispersion liquid of the crystalline polyester resin in an aqueous medium; and a step of forming toner base particles by aggregating fine particles comprising the release agent and the crystalline polyester resin fine particles by raising the temperature of the mixed dispersion liquid.

* * * * *